US011230930B2

(12) United States Patent
Hoefler et al.

(10) Patent No.: US 11,230,930 B2
(45) Date of Patent: Jan. 25, 2022

(54) COOLING ASSEMBLY FOR A TURBINE ASSEMBLY

(71) Applicant: General Electric Company, Schenectady, NY (US)

(72) Inventors: Florian Hoefler, Niskayuna, NY (US); Thomas Fauner, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 93 days.

(21) Appl. No.: 16/499,983

(22) PCT Filed: Apr. 7, 2017

(86) PCT No.: PCT/US2017/026705

§ 371 (c)(1),
(2) Date: Oct. 1, 2019

(87) PCT Pub. No.: WO2018/186891

PCT Pub. Date: Oct. 11, 2018

(65) Prior Publication Data

US 2021/0102466 A1 Apr. 8, 2021

(51) Int. Cl.
*F01D 5/18* (2006.01)

(52) U.S. Cl.
CPC ..... *F01D 5/187* (2013.01); *F05D 2240/304* (2013.01); *F05D 2260/2214* (2013.01); *F05D 2260/232* (2013.01)

(58) Field of Classification Search
None
See application file for complete search history.

(56) References Cited

U.S. PATENT DOCUMENTS 4,407,632 A 10/1983 Liang
6,290,462 B1 9/2001 Ishiguro et al.
(Continued)

FOREIGN PATENT DOCUMENTS

EP 0945595 A2 9/1999
EP 1548230 A2 6/2005
(Continued)

OTHER PUBLICATIONS

Japanese Notice of Refusal Office Action & Translation Corresponding to JP2019553000.
(Continued)

*Primary Examiner* — Michael Lebentritt
(74) *Attorney, Agent, or Firm* — Dority & Manning, P.A.

(57) ABSTRACT

A cooling assembly comprises a cooling cavity disposed inside of a turbine assembly. The cooling cavity is configured to direct cooling air inside a body of the turbine assembly. The cooling assembly comprises a cross-bank fluidly coupled with the cooling cavity and positioned to direct at least some of the cooling air out of the cooling cavity and outside of the body. The cross-bank comprises plural pins having first ends coupled with a first side interior surface of the body and opposite second ends coupled with a second side interior surface of the body. The cross-bank also includes a cross-bar connecting the pins. The cross-bar extends between the pins such that the cross-bar has a first end coupled with an exterior surface of a first pin of the pins and an opposite second end coupled with an exterior surface of a second pin of the pins.

18 Claims, 17 Drawing Sheets

(56) References Cited

U.S. PATENT DOCUMENTS

| | | | | |
|---|---|---|---|---|
| 7,175,386 | B2 | 2/2007 | Cherolis et al. | |
| 7,544,044 | B1 | 6/2009 | Liang | |
| 7,575,414 | B2 | 8/2009 | Lee | |
| 7,625,178 | B2 | 12/2009 | Morris et al. | |
| 7,690,894 | B1 | 4/2010 | Liang | |
| 8,070,441 | B1 | 12/2011 | Liang | |
| 8,668,453 | B2 | 5/2014 | Lee et al. | |
| 9,267,381 | B2 | 2/2016 | Morris et al. | |
| 9,366,144 | B2 | 6/2016 | Zess et al. | |
| 9,382,804 | B2 | 7/2016 | Saxer-Felici et al. | |
| 2005/0169762 | A1* | 8/2005 | Blume | B22C 21/14 416/223 R |
| 2006/0222497 | A1 | 10/2006 | Lee | |
| 2007/0258814 | A1 | 11/2007 | Metrisin et al. | |
| 2008/0286104 | A1* | 11/2008 | Liang | F01D 5/187 416/95 |
| 2010/0183427 | A1 | 7/2010 | Liang | |
| 2010/0221121 | A1 | 9/2010 | Liang | |
| 2010/0236759 | A1 | 9/2010 | Wadley et al. | |
| 2011/0164960 | A1* | 7/2011 | Maldonado | F01D 5/186 415/115 |
| 2012/0269649 | A1 | 10/2012 | Rawlings et al. | |
| 2013/0084191 | A1* | 4/2013 | Jiang | F01D 5/186 416/97 R |
| 2014/0093389 | A1* | 4/2014 | Morris | F01D 5/183 416/97 R |
| 2015/0044029 | A1 | 2/2015 | Tibbott et al. | |
| 2015/0147158 | A1 | 5/2015 | Wang et al. | |
| 2015/0159489 | A1* | 6/2015 | Lee | F01D 5/189 416/97 R |
| 2015/0176412 | A1 | 6/2015 | Krueckels et al. | |
| 2016/0023272 | A1 | 1/2016 | Mongillo, Jr. et al. | |
| 2016/0245097 | A1* | 8/2016 | Jones | F01D 25/12 |
| 2016/0305253 | A1* | 10/2016 | Szijarto | F01D 5/187 |
| 2017/0167268 | A1* | 6/2017 | Bunker | F01D 25/12 |
| 2017/0248022 | A1* | 8/2017 | Zhang | F04D 29/582 |
| 2017/0254207 | A1* | 9/2017 | Schetzel | F01D 5/147 |
| 2019/0032495 | A1* | 1/2019 | Weaver | F01D 25/12 |
| 2019/0078441 | A1* | 3/2019 | Clum | B23P 15/02 |
| 2019/0338649 | A1* | 11/2019 | Jennings | F01D 5/187 |
| 2020/0024965 | A1* | 1/2020 | Frey | F01D 5/187 |
| 2020/0024967 | A1* | 1/2020 | Spangler | F01D 9/041 |
| 2020/0095869 | A1* | 3/2020 | Lee | F01D 5/187 |
| 2020/0149416 | A1* | 5/2020 | Arisi | F01D 9/041 |
| 2020/0190989 | A1* | 6/2020 | Fujii | F01D 5/186 |
| 2020/0190998 | A1* | 6/2020 | Xu | F01D 5/187 |
| 2020/0332664 | A1* | 10/2020 | Mongillo, Jr. | F01D 5/147 |
| 2020/0332667 | A1* | 10/2020 | Mongillo, Jr. | F01D 5/189 |
| 2020/0347735 | A1* | 11/2020 | Webster | F01D 5/186 |
| 2021/0017869 | A1* | 1/2021 | Osgood | F01D 25/14 |
| 2021/0054754 | A1* | 2/2021 | Generale | F01D 9/065 |

FOREIGN PATENT DOCUMENTS

| | | | | |
|---|---|---|---|---|
| EP | 1707741 | A2 | 10/2006 | |
| EP | 2886797 | A1 * | 6/2015 | F01D 5/187 |
| EP | 2886797 | A1 | 6/2015 | |
| JP | S62126208 | A | 6/1987 | |
| JP | 2010/144722 | A | 7/2010 | |
| JP | 2014/177900 | A | 9/2014 | |

OTHER PUBLICATIONS

PCT Search Report & Written Opinion Corresponding to PCT/US2017/026705 dated Apr. 7, 2017.

Kruekels et al., Heat Transfer in a Vane Trailing Edge Passage with Conical Pins and Pin-Turbulator Integrated Configurations, ASME Turbo Expo, Paper No. GT2014-25522, 2014, 11 pages.

Taslim et al., A Combined Numerical and Experimental Study of Heat Transfer in a Cooling Channel Roughened with 90 Ramped Ribs, Journal of Mechanical and Industrial Engineering Department, ISROMAC-44042, 2016, pp. 1-10.

Machine Translated Japanese Decision to Grant Patent Corresponding to Application No. 2019553000 dated Oct. 7, 2021.

* cited by examiner

COOLING ASSEMBLY FOR A TURBINE ASSEMBLY

FIELD

The subject matter described herein relates to cooling turbine assemblies.

BACKGROUND

The turbine assembly is subjected to increased heat loads when an engine is operating. To protect the turbine assembly components from overheating and damage, cooling fluid may be directed in and/or onto the turbine assembly. Component temperature can then be managed through a combination of impingement onto, cooling flow through passages in the component, and film cooling with the goal of balancing component life and turbine efficiency. Improved efficiency can be achieved through increasing the firing temperature, reducing the cooling flow, or a combination.

In particular, the trailing ends of known turbine blades and/or vanes, and turbine inner and outer sidewalls can be difficult to cool when the engine is operating. One issue with cooling the trailing ends of turbine airfoils (e.g., turbine blades or vanes) is inadequate heat transfer within the airfoil. Inadequate heat transfer may cause the average and/or local material temperature of the turbine assembly blade or vane to remain excessively high, which may reduce part lifetime below acceptable levels or require use of additional cooling fluid. Therefore, an improved system may provide improved heat transfer rates and thereby reduce the average and/or local surface temperature of critical portions of the turbine, enable more efficient operation of the engine, and/or improve the life of the turbine machinery.

BRIEF DESCRIPTION

In one embodiment, a cooling assembly comprises a cooling cavity disposed inside of a turbine assembly. The cooling cavity is configured to direct cooling air inside a body of the turbine assembly. The cooling assembly comprises a cross-bank fluidly coupled with the cooling cavity and positioned to direct at least some of the cooling air out of the cooling cavity and outside of the body. The cross-bank comprises plural pins having first ends coupled with a first side interior surface of the body and opposite second ends coupled with a second side interior surface of the body. The cross-bank also includes a cross-bar connecting the pins. The cross-bar extends between the pins such that the cross-bar has a first end coupled with an exterior surface of a first pin of the pins and an opposite second end coupled with an exterior surface of a second pin of the pins.

In one embodiment, a cooling assembly comprises a cooling cavity disposed inside of a turbine assembly. The cooling cavity is configured to direct cooling air inside a body of the turbine assembly. The cooling assembly includes a cross-bank fluidly coupled with the cooling cavity and positioned to direct at least some of the cooling air out of the cooling cavity and outside of the body. The cross-bank comprises plural pins having first ends coupled with a first side interior surface of the body and opposite second ends coupled with a second side interior surface of the body. The cross-bank also includes a cross-bar connecting the pins, wherein the cross-bar is spaced apart from the first side interior surface and the cross-bar is spaced apart from the second side interior surface.

In one embodiment, a cooling assembly comprises a cooling cavity disposed inside of a turbine assembly. The cooling cavity is configured to direct cooling air inside a body of the turbine assembly. The cooling assembly comprises a cross-bank fluidly coupled with the cooling cavity and positioned to direct at least some of the cooling air out of the cooling cavity and outside of the body. The cross-bank comprises plural pins arranged in linear rows. The pins having first ends coupled with a first side interior surface of the body and opposite second ends coupled with a second side interior surface of the body. The cross-bank also includes cross-bars connecting the pins. The cross-bars extending between the pins such that a first cross-bar of the cross-bars has a first end coupled with an exterior surface of a first pin of the pins and an opposite second end coupled with an exterior surface of a second pin of the pins. The cross-bars are spaced apart from the first side interior surface and the cross-bars are spaced apart from the second side interior surface.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
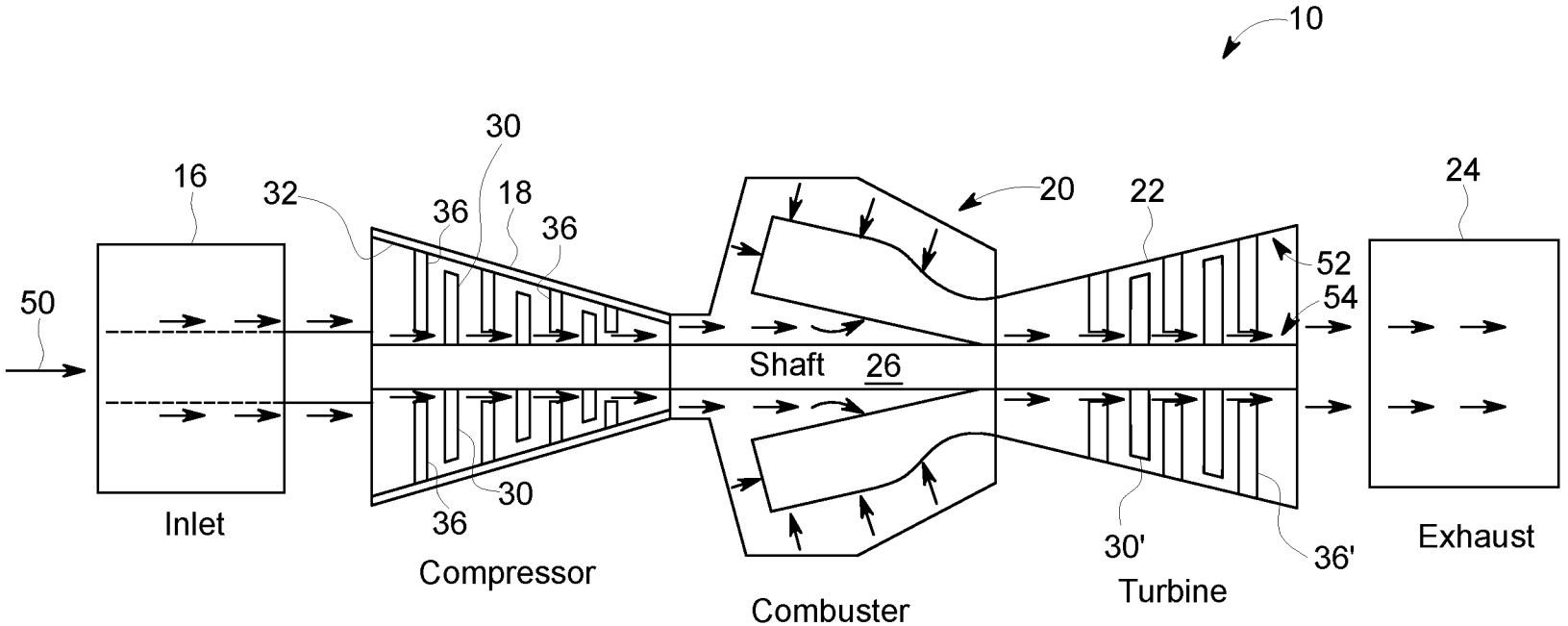
FIG. 1 illustrates a turbine assembly in accordance with one embodiment.

Reference will be made below in detail to example embodiments of the inventive subject matter, examples of which are illustrated in the accompanying drawings. Wherever possible, the same reference numerals used throughout the drawings refer to the same or like parts.

One or more embodiments of the inventive subject matter described herein relate to systems and methods that effectively internally cool inner sidewalls, outer sidewalls, and a trailing end of a turbine airfoil. Turbine assemblies can include cooling cavities that direct cooling fluids through passages and slots of the airfoil, and inner and outer sidewalls in order to effectively cool the airfoil and sidewalls when an engine is operating. Often, the trailing end of the airfoil is difficult to cool. For example, cooling fluid directed from the cooling cavity may already be hot when the fluid arrives at the trailing end of the airfoil. Additionally, the trailing end has a relatively thin width between a first side (e.g., a pressure side of the airfoil) and a second side (e.g., a suction side of the airfoil) which limits the cooling techniques that may be applied to the trailing end.

One or more technical effects of the subject matter described herein is that of a cross-bank. Having a pin bank with cross-bars promotes mixing of the cooling fluid flow, increases flow velocities close to internal walls of the airfoil, and generates a flow unsteadiness with an amplitude perpendicular to the internal walls of the airfoil. This results in improved internal heat transfer rates at the trailing end of the airfoil and improved cooling which may extend part life and reduce unplanned outages relative to turbine airfoils that do not have pin banks with cross-bars.

FIG. 1 illustrates a turbine assembly 10 in accordance with one embodiment. The turbine assembly 10 includes an inlet 16 through which air enters the turbine assembly 10 in the direction of arrow 50. The air travels in direction 50 from the inlet 16, through a compressor 18, through a combustor 20, and through a turbine 22 to an exhaust 24. A rotating shaft 26 runs through and is coupled with one or more rotating components of the turbine assembly 10.

The compressor 18 and the turbine 22 comprise multiple airfoils. The airfoils may be one or more blades 30, 30' or guide vanes 36, 36'. The blades 30, 30' are axially offset from the guide vanes 36, 36' in the direction 50. The guide vanes 36, 36' are stationary components and extend from outer sidewalls 52 of the turbine 22. The blades 30, 30' extend from inner sidewalls 54 of the turbine 22 and are operably coupled with and rotate with the shaft 26.

Figure 2A:
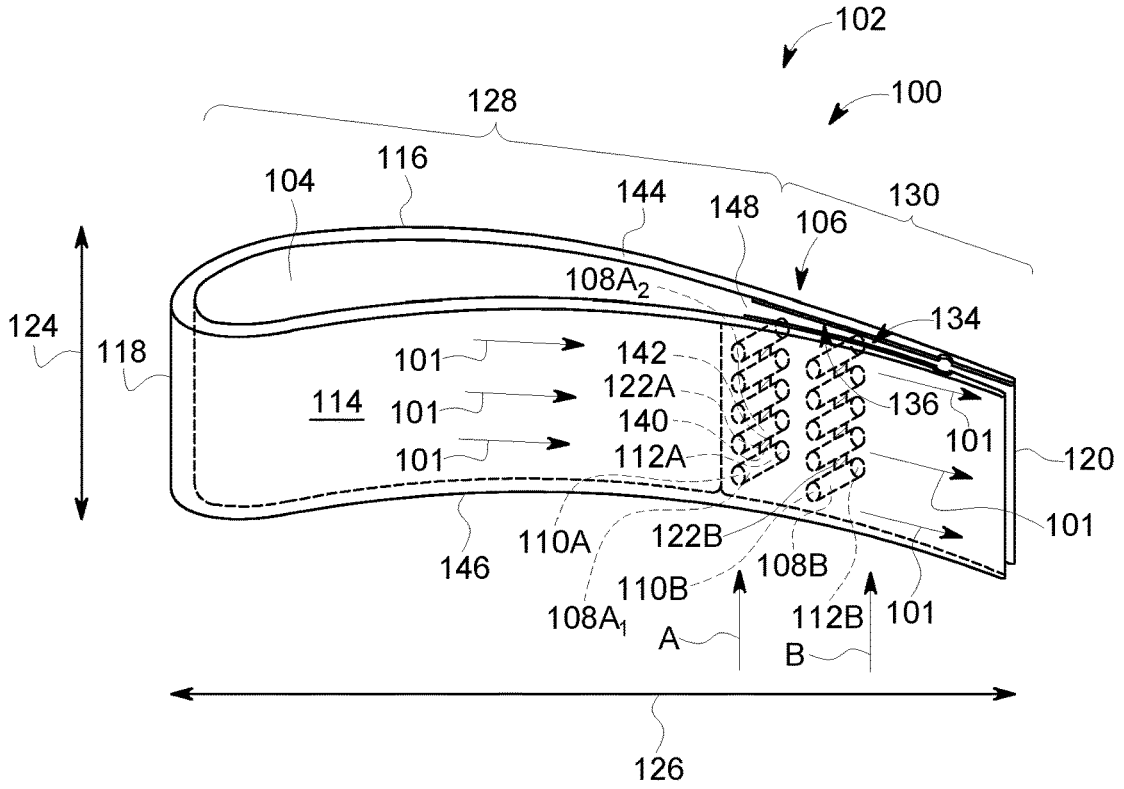
FIG. 2A illustrates a cross-sectional perspective view of a cooling assembly in accordance with one embodiment.

FIG. 2A illustrates a perspective cross-sectional view of a cooling assembly 100 in accordance with one embodiment. The cooling assembly 100 includes a body 102 of the turbine assembly 10 of FIG. 1. In the illustrated embodiment of FIG. 2A, the body 102 is an airfoil of the turbine assembly. Additionally or alternatively, the body 102 could be any alternative structure. The airfoil 102 may be a stator vane, a turbine vane, a rotating blade, or the like, used in the turbine assembly 10. The airfoil 102 has a pressure side 114 and a suction side 116 that is opposite the pressure side 114. The pressure side 114 and the suction side 116 are interconnected by a leading edge 118 and a trailing edge 120 that is opposite the leading edge 118. The pressure side 114 is generally concave in shape, and the suction side 116 is generally convex in shape between the leading and trailing edges 118, 120. For example, the generally concave pressure side 114 and the generally convex suction side 116 provides an aerodynamic surface over which compressed working fluid flows through the turbine assembly.

The airfoil 102 extends an axial length 126 between the leading edge 118 and the trailing edge 120. The airfoil 102 extends a radial length 124 between a first end 144 and an opposite second end 146. For example, the axial length 126 is generally perpendicular to the radial length 124. The second end 146 is disposed proximate the shaft 26 of the turbine assembly 10 (of FIG. 1) relative to the first end 144 along the radial length 124.

The airfoil has a leading end 128 and a trailing end 130. The leading and trailing ends 128, 130 extend along the axial length 126 of the airfoil 102 between the leading edge 118 and the trailing edge 120. The leading end 128 extends from the leading edge 118 to an inlet 148 of a cross-bank 106. The trailing end 130 extends from the inlet 148 of the cross-bank 106 to the trailing edge 120. The cross-bank 106 is disposed at the trailing end 130 of the airfoil 102. Additionally or alternatively, the cross-bank 106 may be disposed in one or more of the leading end 128 or the trailing end 130.

A cooling cavity 104 is disposed at the leading end 128 of the airfoil 102. The cooling cavity 104 is disposed within the airfoil 102. In the illustrated embodiment, the cooling cavity 104 is shown as completely hollow. Alternatively, the airfoil 102 may include several cooling passages and/or serpentines, impingement baffles and/or openings, or the like, from the interior cooling cavity 104 to outside of the cooling cavity 104. Additionally or alternatively, the airfoil 102 may include one or more film cooling holes extending from the interior of the airfoil 102 to the exterior of the airfoil 102 along one or more of the pressure side 114, the suction side 116, the leading end 128 or the trailing end 130 in order to provide film cooling over interior and exterior surfaces of the airfoil 102.

The cooling cavity 104 is fluidly coupled with the cross-bank 106. The cross-bank 106 is positioned proximate to the trailing edge 120 relative to the cooling cavity 104 in order for the cooling cavity 104 to direct cooling air exiting the cooling cavity 104 through the cross-bank 106 towards the trailing edge 120 and outside of the airfoil 102. For example, the cooling cavity 104 directs at least some of the cooling air exiting the cooling cavity 104 in a direction 101. Alternatively, the cooling cavity 104 may direct cooling fluid, coolant, or the like towards the cross-bank 106.

The cross-bank 106 includes plural pins 108. The pins 108 have first ends 110 and second ends 112. The first ends 110 are coupled with a first side interior surface 134 of the airfoil 102. For example, in the illustrated embodiment, the first side interior surface 134 may be a pressure side interior surface of the airfoil 102. The second ends 112 are coupled with a second side interior surface 136 of the airfoil 102. For example, in the illustrated embodiment, the second side interior surface 136 may be a suction side interior surface of the airfoil 102. The pins 108 are positioned within the cross-bank 106 such that the pins generate unsteady flow patterns of the cooling air flowing in the direction 101 from the cooling cavity 104 towards the trailing edge 120. For example, the pins 108 are elongated between the first side interior surface 134 and the second side interior surface 136 and oriented generally perpendicular to the direction 101 of cooling air exiting the cooling cavity 104. Additionally or alternatively, the pins 108 may be oriented generally non-perpendicular to the direction 101 of the cooling air exiting the cooling cavity 104. In the illustrated embodiment of FIG. 2A, the pins 108 are positioned within the interior of the airfoil 102 between the first end 144 and the second end 146 along the radial length 124. Optionally, the cross-bank 106 may have pins 108 that do not extend from the first end 144 to the second end 146. For example, the pins 108 may be positioned such that the cross-bank 106 only extends generally half of the length of the radial length 124. The pins 108 will be described in more detail below.

The cross-bank 106 also includes cross-bars 122 that connect with the pins 108. For example, a single cross-bar 122 extends between two pins 108 such that the cross-bar 122 has a first end 140 that is coupled with an exterior surface of a first pin 108*a*1 and the cross-bar 122 has an opposite second end 142 that is coupled with an exterior surface of a different, second pin 108*a*2. Additionally or alternatively, the cross-bar 122 may be coupled with an interior surface of the first and second pins 108*a*1, 108*a*2. For example, the cross-bar 122 may extend from a position near or substantially near the center of the first pin 108*a*1 to a position near or substantially near the center of the second pin 108*a*2. The cross-bars 122 are positioned within the cross-bank 106 such that the cross-bars 122 generate unsteady flow patterns of the cooling air flowing in the direction 101 from the cooling cavity 104 towards the trailing edge 120. For example, the cross-bars 122 are elongated between the first and second pins 108*a*1, 108*a*2 and oriented generally perpendicular to the first and second pins 108*a*1, 108*a*2 and generally perpendicular to the direction 101 of cooling air exiting the cooling cavity 104. The cross-bars will be described in more detail below.

In the illustrated embodiment of FIG. 2A, the cross-bank 106 includes a first linear row A of pins 108*a* and cross-bars 122*a*, and a second linear row B of additional pins 108*b* and additional cross-bars 122*b*. The first and second rows are illustrated as columns that extend along the radial length 124 between the first and second ends 144, 146 and are disposed between the cooling cavity 104 and the trailing edge 120. In the illustrated embodiment, only first and second rows are present. Additionally or alternatively, the cross-bank 106 may include more than two or less than two rows of pins and cross-bars.

Figure 2B:
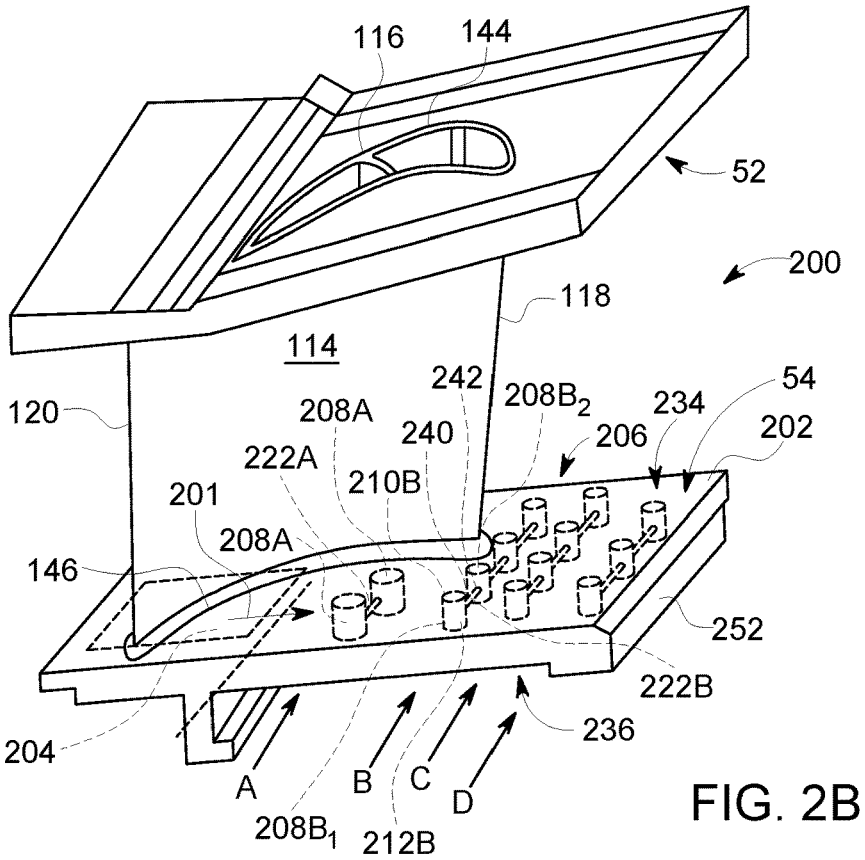
FIG. 2B illustrates a cross-sectional perspective view of a cooling assembly in accordance with one embodiment.

FIG. 2A illustrates one example of a cross-bank 106 disposed within an airfoil of the turbine assembly 10. Alternatively, a cross-bank may be disposed within the outer sidewall 52, the inner sidewall 54, or the like, of the turbine assembly 10 (of FIG. 1). For example, FIG. 2B illustrates a perspective cross-sectional view of a cooling assembly 200 having a cross-bank 206 disposed within the inner sidewall 54 of the turbine assembly 10 in accordance with one embodiment. The cooling assembly 100 includes a body 202 of the turbine assembly 10 of FIG. 1. In the illustrated embodiment of FIG. 2B, the body 202 is the inner sidewall 54 of the turbine assembly 10. Additionally or alternatively, the body 202 could be any alternative structure.

The cross-bank 206 includes plural pin 208. The pins 208 have first ends 210 and second ends 212 (corresponding to the pins 108 having first and second ends 110, 112 of FIG. 2A). The first ends 210 are coupled with a first side interior surface 234 of the inner sidewall 54 and the second ends 212 are coupled with a second side interior surface 236 of the inner sidewall 54. For example, in the illustrated embodiment of FIG. 2B, the first side interior surface 234 may be an inside wall of the inner side wall 54, and the second side interior surface 236 may be an outside wall of the inner side wall 54. For example, the outside wall may be disposed proximate to the shaft 26 compared to the inside wall. The pins 208 are positioned within the cross-bank 206 such that the pins generate unsteady flow patterns of the cooling air flowing in the direction 201 from a cooling cavity 204 towards an end wall 252 of the inner sidewall 54.

The cross-bank 206 also includes cross-bars 222 that connect with the pins 208. For example, a single cross-bar 222 extends between two pins 208 such that the cross-bar 222 has a first end 240 that is coupled with an exterior surface of a first pin 208*b*1 and the cross-bar 222 has an opposite second end 242 that is coupled with an exterior surface of a different, second pin 108*b*2. The cross-bars 222 are positioned within the cross-bank 206 such that the cross-bars 222 generate unsteady flow patterns of the cooling air flowing in the direction 201, within the inner side wall 54, from the cooling cavity 204 towards the end wall 252.

FIGS. 2A and 2B illustrate two examples of two different bodies of a turbine assembly having cross-banks 106, 206. For example, body 102 is representative of the airfoil of the turbine assembly, and body 202 is representative of the inner side wall of the turbine assembly. Additionally or alternatively, a cross-bank may be disposed within any alternative body of a turbine assembly. For example, a cross-bank may be disposed within the outer side wall, within a shroud or casing of the turbine assembly, within an inner and/or outer side wall of the compressor, or the like.

Figure 3:
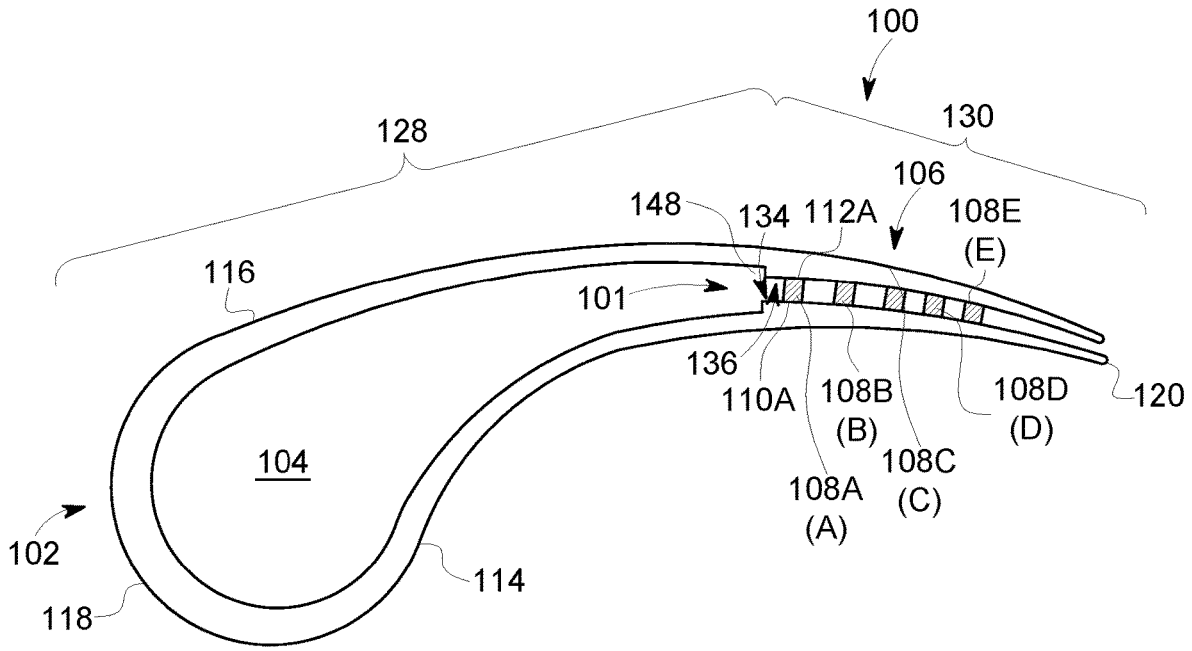
FIG. 3 illustrates a cross-sectional top view of an airfoil in accordance with one embodiment.

Referring back to the cooling assembly 100 of FIG. 2A, FIG. 3 illustrates a cross-sectional top view of the airfoil 102 of FIG. 2A in accordance with one embodiment. The cross-bank 106 illustrated in FIG. 3 includes five linear rows (A, B, C, D, and E) having pins 108 (*a-e*, respectively) and cross-bars (not shown). Alternatively, the cross-bank 106 may include less than five or more than five rows of pins 108 and cross-bars. The first ends 110 of the pins 108 are coupled with the first side interior surface 134. The second ends 112 of the pins 108 are coupled with the second side interior surface 136. For example, the pins 108 may be coupled to the interior surfaces 134, 136 of the airfoil 102 by one or more of welding, casting, fastening, machining, adhering, or the like. Optionally, the pins 108*a* of the first row A may be coupled with the interior surfaces 134, 136 using one method, and the pins 108 of one or more of the additional rows B, C, D, or E may be coupled with the interior surfaces using a common or unique method.

Figure 4:
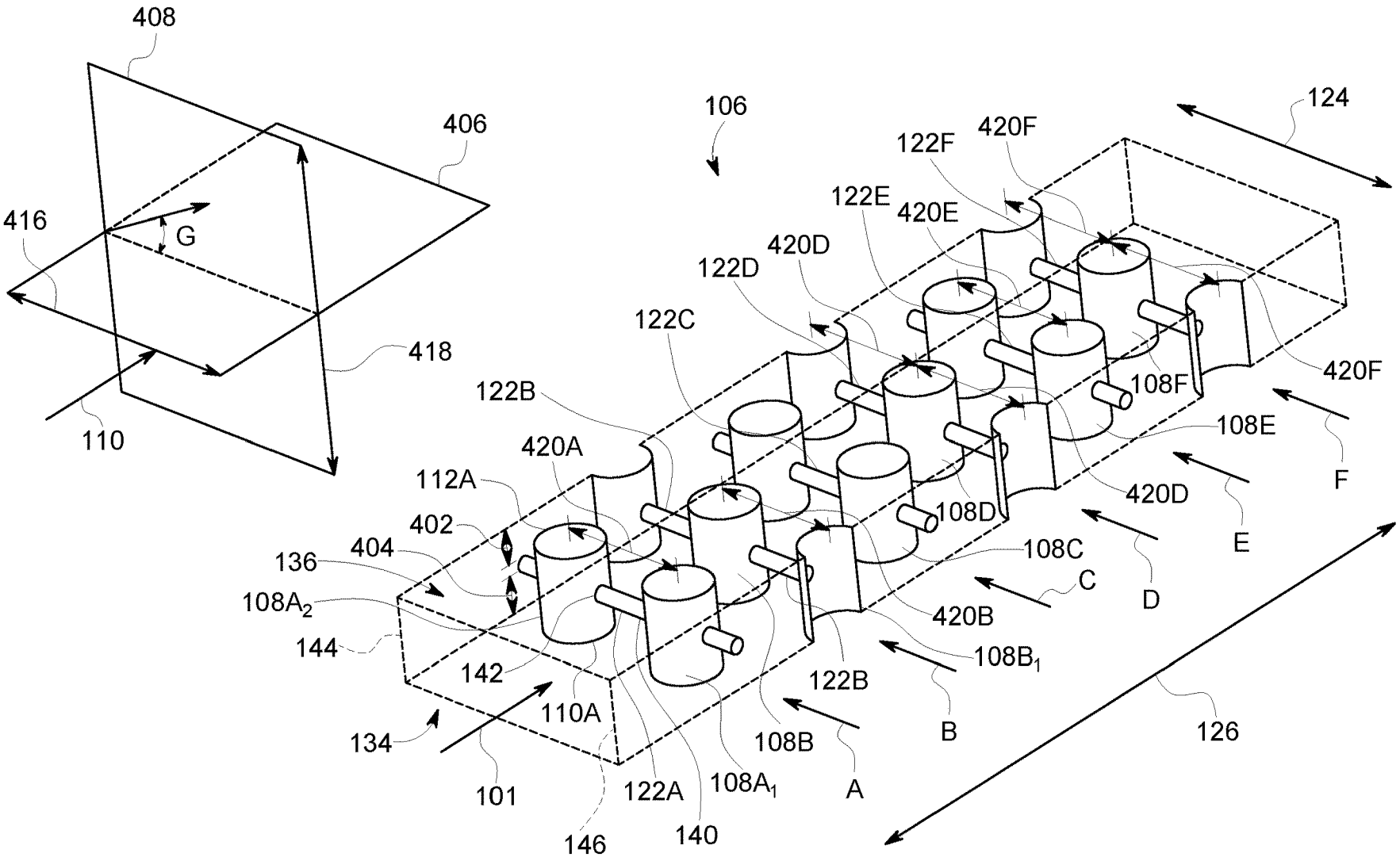
FIG. 4 illustrates a cross-sectional partial perspective view of a cross-bank in accordance with one embodiment.

FIG. 4 illustrates a cross-sectional partial perspective view of the cross-bank 106 of the cooling assembly 100. The cross-bank 106 illustrated in FIG. 4 includes six rows having pins 108 and cross-bars 122. The pins 108 are elongated between the first side interior surface 134 and the second side interior surface 136. In the illustrated embodiment, the pins 108 are generally cylindrical with a generally circular cross-sectional shape. Additionally or alternatively, the pins 108 may have an oval, rectangular, elliptical cross-sectional shape, or the like. The pins 108 of the linear rows A, B, C, D, E, and F are all illustrated having a uniform cross-sectional shape and size. Alternatively, one or more pins 108 of the rows A, B, C, D, E, or F may have a unique cross-sectional shape and/or size. For example, the pins 108 of the rows A, D, E may have a uniform shape and size, the pins 108 of the rows B, C, and F may have a uniform shape and size that is unique to the shape and/or size of the pins 108 of rows A, D, E, or any combination thereof.

In the illustrated embodiment, the pins 108 of the rows A, B, C, D, E and F are positioned such that the pins 108 are spaced apart by a distance 420 along the radial length 124. For example, the pins 108*a* of the first row A are spaced apart by the distance 420*a*, and the pins 108*b* of the second row are spaced apart by the distance 420*b* that is generally uniform to the distance 420*a*. Additionally, the pins of the rows C, D, E and F are spaced apart by the distances 420, respectively. Additionally or alternatively, the pins of one or more of the rows A, B, C, D, E or F may be spaced apart by a distance that is greater than the distance 420 or less than the distance 420. For example, the pins 108*f* of the row F may be spaced apart by a distance greater than the distance 420, or the pins 108*c* of the row C may be spaced apart by a distance less than the distance 420, or the like. The pins 108 of one or more of the rows A, B, C, D, E, or F may be spaced apart a uniform or unique distance as the pins of one or more of the additional rows A, B, C, D, E or F. Additionally or alternatively, the pins 108*a* of the row A may be spaced apart a uniform distance 420 or a unique distance 420. Optionally, the pins 108 may have a uniform repeating configuration along the radial length 124, may have a random configuration along the radial length 124, or any combination thereof.

The cross-bars 122 are elongated and extend between the exterior surfaces of two pins 108. For example, the cross-bar 122*a* extends between a first pin 108*a*1 and a second pin 108*a*2. In the illustrated embodiment, the cross-bars 122 are generally cylindrical with a generally circular cross-sectional shape. Additionally or alternatively, the cross-bars 122 may have an oval, rectangular, elliptical cross-sectional shape, or the like. The cross-bars 122 of the rows A, B, C, D, E and F are all illustrated as having a uniform cross-sectional shape and size. Alternatively, one or more cross-bars 122 of one or more of the rows A, B, C, D, E, or F may have a unique cross-sectional shape and/or size. For example, the cross-bars 122 of the rows A, D, E may have a uniform shape and size, the cross-bars of the rows B, C, F may have a uniform shape and size that is unique to the shape and/or size as the cross-bars 122 of rows A, D, E, or any combination thereof.

The first ends 140 and the second ends 142 of the cross-bars 122 are coupled with the exterior surfaces of the pins 108. For example, the first end 140 of the cross-bar 122*a* is coupled with the exterior surface of the first pin 108*a*1. The opposite second end 142 of the cross-bar 122*a* is coupled with the exterior surface of the second pin 108*a*2. The cross-bars 122 may be coupled to the exterior surfaces of the pins 108 by one or more of welding, casting, fastening, machining, adhering, or the like. Optionally, the cross-bars 122*a* of the first linear row A may be coupled with the exterior surfaces of the pins 108 using one method, and the cross-bars 122 of one or more of the additional rows B, C, D, E, or F may be coupled with the exterior surface of the pins 108 using a common or unique method. In the illustrated embodiment, a single cross-bar 122 extends between two pins 108. Optionally, one or more cross-bars 122 may extend between two or more pins 108. For example, a first cross-bar and a second cross-bar may extend between the pins 108*a*1 and 108*a*2, a first cross-bar may extend between the pins 108*a*1 and 108*a*2 and a second cross-bar may extend between the pins 108*a*1 and 108*b*1, or the like.

The cross-bars 122 are spaced apart from the first side interior surface 134 by a distance 404. Additionally, the cross-bars 122 are spaced apart from the second side interior surface 136 by a distance 402. In the illustrated embodiment of FIG. 4, the distances 402 and 404 are generally uniform. Alternatively, the distance 402 may be more or less than the distance 404. For example, the cross-bars 122 may be separated from the s first side interior surface 134 by the distance 404 that is greater than the distance 402 that separates the cross-bars 122 from the second side interior surface 136. For example, the cross-bars 122 may be disposed closer to one of the first side interior surface 134 or the second side interior surface 136. In the illustrated embodiment, each of the cross-bars 122 of the rows A, B, C, D, E, and F are spaced apart from the first side and second side interior surfaces 134, 136 by generally uniform distances 402, 404. For example, the cross-bars 122 of the row A are spaced apart from the interior surfaces 134, 136 by generally the same distances 402, 404 as the cross-bars 122 of the row B. Alternatively, the cross-bars 122 of the row A may be disposed closer to the first side interior surface 134 than the cross-bars 122 of the row B, or the like.

The cross-bars 122 are elongated along a bar plane 406. For example, the cross-bars 122 are elongated along the bar plane 406 in a direction 416 between the first end 144 and the second end 146 along the radial length 124 of the airfoil 102 (of FIG. 2A). Additionally or alternatively, the cross-bars 122 may be elongated along a different bar plane 406. For example, one or more cross-bars 122 may be elongated in a direction generally offset from the bar plane 406 by an angular degree G within a pin plane 408. In the illustrated embodiment of FIG. 4, each cross-bar 122 is elongated in the direction 416 within the bar plane 406. Optionally, one or more cross-bars 122 may be elongated in a different direction within the bar plane 406. The alternative embodiments will be described in more detail below.

The pins 108 are elongated along the pin plane 408. The pin plane 408 is a different plane than the bar plane 406. The pins 108 are elongated along the pin plane 408 in a direction 418 between the first side interior surface 134 and the second side interior surface 136. In the illustrated embodiment of FIG. 4, each pin 108 is elongated in the direction 418 within the pin plane 408. The pin plane 408 is generally perpendicular to the bar plane 406. For example, the pins 122 are elongated in the direction 418 that is generally perpendicular to the cross-bars 122 elongated in the direction 416. Alternatively, the pin plane 408 may be non-perpendicular to the bar plane 406. Optionally, one or more pins 108 may be elongated in a different direction within the pin plane 408. The alternative embodiments will be described in more detail below.

Figure 5A:
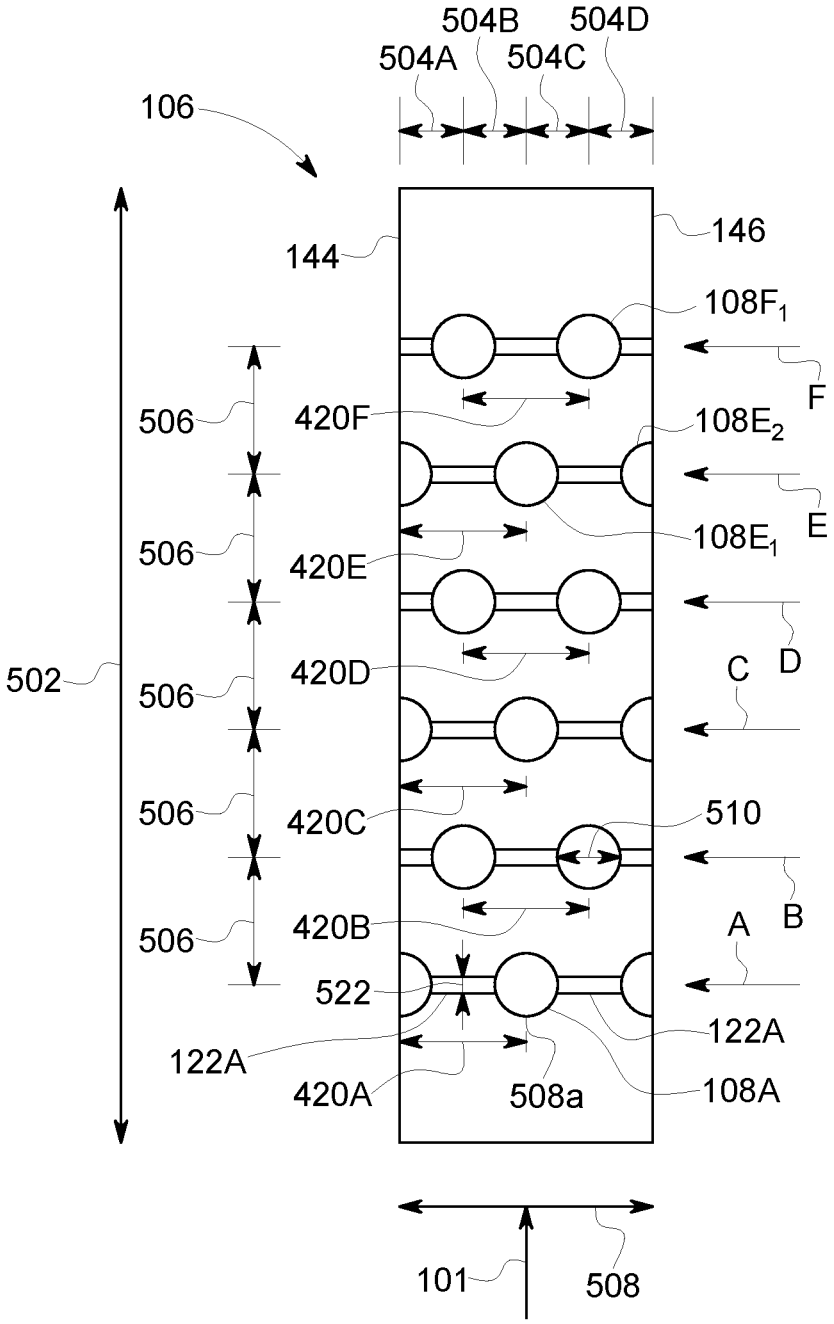
FIG. 5A illustrates a top view of the cross-bank of FIG. 4 in accordance with one embodiment.
Figure 5B:
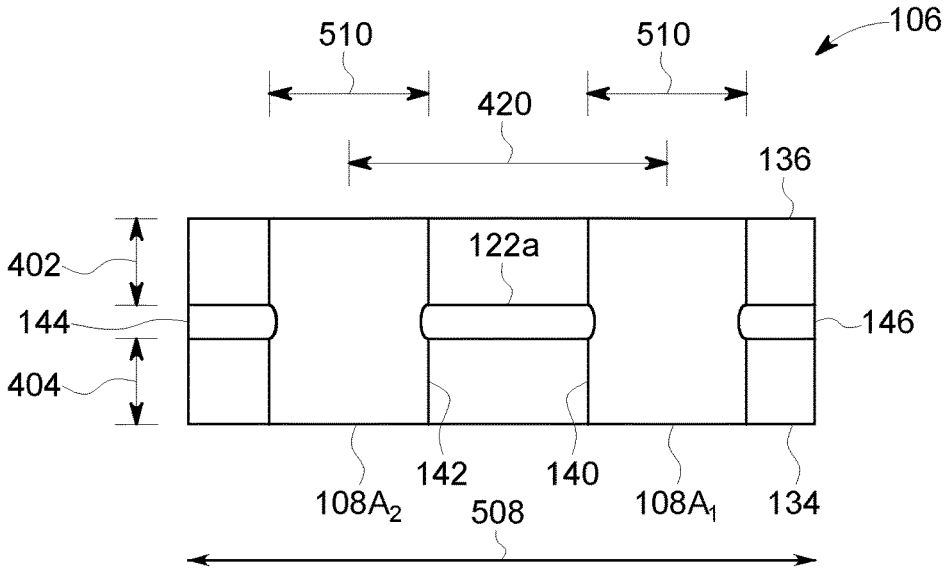
FIG. 5B illustrates a side view of the cross-bank of FIG. 4 in accordance with one embodiment.

FIG. 5A illustrates a top view of the cross-bank 106 of FIG. 4 in accordance with one embodiment. FIG. 5B illustrates a side view of the cross-bank 106 of FIG. 4. The cross-bank 106 extends a cross-bank length 502. For example, the cross-bank length 502 extends generally in the direction of the axial length 126 (of FIG. 4). The cooling cavity 104 (of FIG. 2A) directs cooling air through the cross-bank 106 in the direction 101. The linear rows A, B, C, D, E and F of the pins 108 are positioned a distance 506 apart along the cross-bank length 502 such that the pins 108*a* of the row A are spaced apart the distance 506 from the pins 108*b* of the row B. In the illustrated embodiment, the pins 108 of the rows A, B, C, D, E and F are spaced apart a uniform distance 506. Optionally, one or more of the pins 108 of one or more of the rows A, B, C, D, E or F may be spaced apart a distance greater than or less than the distance 506. For example, the pins 108*b* of row B may be positioned closer to the pins 108*c* of row C than the pins 108*a* of row A.

The cross-bank 106 extends a cross-bank width 508. For example, the cross-bank width 508 extends generally in the direction of the radial length 124 (of FIG. 4). The pins 108 are axially offset from the additional pins 108 of the cross-bank 106 in the direction of the cooling airflow 101 along the axial length 126 of the airfoil 102 (of FIG. 2A). For example, the pins 108 of the rows A, B, C, D, E and F are positioned a staggered distance apart 504 along the cross-bank width 508 such that the pins 108*f* of the row F are spaced apart the staggered distance 504*a* from the pins 108*e* of the row E. In the illustrated embodiment, the pins 108 of the rows A, B, C, D, E and F are spaced apart a uniform staggered distance 504. Optionally, one or more of the pins 108 of one or more of the rows A, B C, D, E or F may be spaced apart a staggered distance greater than or less than the staggered distance 504. For example, the pin 108*f*1 may be positioned closer to the pin 108*e*1 than the pin 108*e*2 along the cross-bank width 508. In the illustrated embodiment, the pins 108 are positioned such that the pins of the linear rows A, C and E (108*a*, 108*c*, 108*e*) are axially aligned along the cross-bank length 502, the pins of the rows B, D and F (108*b*, 108*d*, 108*f*) are axially aligned along the cross-bank length 502, and the pins of the rows A, C, and E are axially offset from the pins of the rows B, D, and F. Additionally or alternatively, the pins 108 may be one or more of axially aligned, axially offset, or any combination thereof along the cross-bank length 502. For example, the pins 108 may have a repeating aligned and/or offset configuration along the axial length 126, may have a random aligned and/or offset configuration along the axial length 126, or any combination thereof.

The pins 108 of the cross-bank 106 are separated from the additional pins in the same linear rows by a distance 420. For example, the pins 108*a* of the first row A are disposed such that the pins 108*a* are spaced apart by a distance 420*a* along the cross-bank width 508 and the pins 108*b* of the second row B are spaced apart by the distance 420*b* that is generally the same as the distance 420*a*. Additionally or alternatively, one or more pins 108 of one or more of the rows A, B, C, D, E, or F may be spaced apart a unique and/or common distance greater than or less than the distance 420.

The pins 108 have a generally circular first cross-sectional shape 510 with a first area corresponding to the first cross-sectional shape 510. The cross-bars 122 have a generally circular second cross-sectional shape 522 with a second area corresponding to the second cross-sectional shape 522. The first cross-sectional shape 510 of the pins 108 is different than the second cross-sectional shape 522 of the cross-bars. The first area corresponding to the first cross-sectional shape 510 of the pins 108 is greater than the second area corresponding to the second cross-sectional shape 522 of the cross-bars 122. For example, the area ratio between the first area (e.g., the area of the pins) and the second area (e.g., the area of the cross-bars) is at least one. Optionally, the area ratio between the first area of the pins and the second area of the cross-bars may be any number greater than 1.

Figure 6:
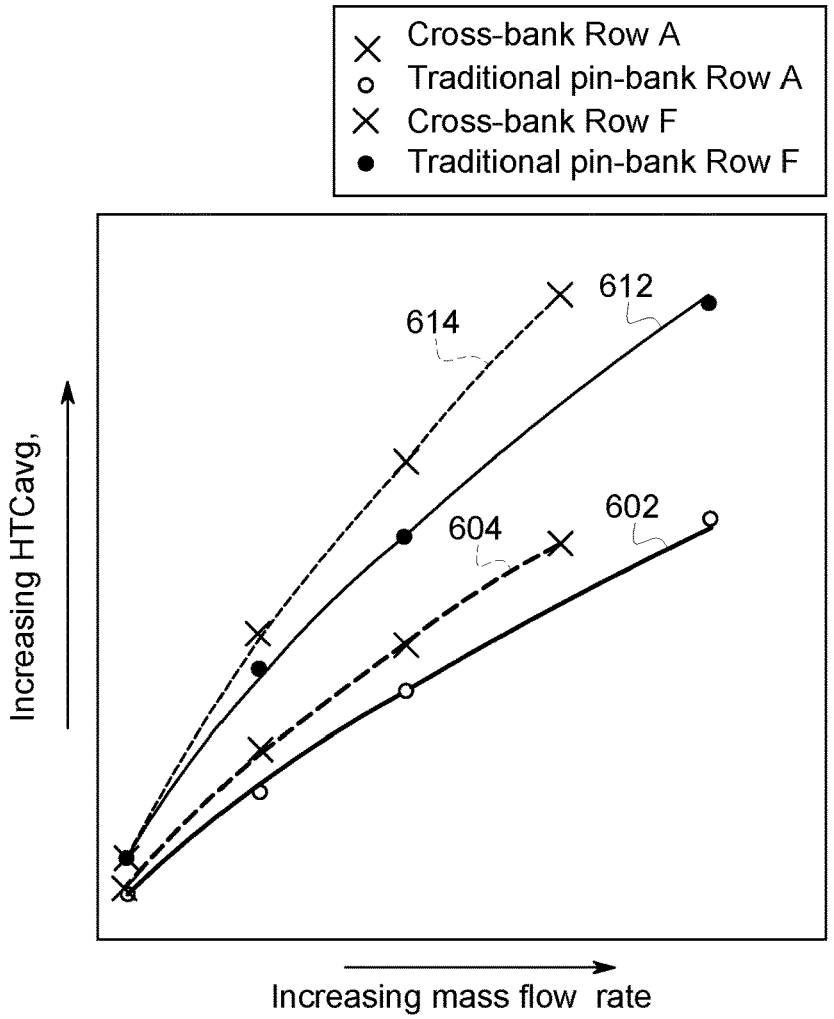
FIG. 6 illustrates a heat transfer coefficient graph in accordance with one embodiment.

FIG. 6 illustrates a heat transfer coefficient graph for an airfoil having a cross-bank 106 (corresponding to the airfoil 102 of FIG. 2A) and for an airfoil having a traditional pin-bank. The horizontal axis represents an increasing mass flow rate of the cooling air exiting a cooling cavity (e.g., the cooling cavity 104). The vertical axis represents increasing heat transfer coefficient values. Line 602 represents a first row (e.g., row A of FIG. 4) at the trailing end 130 of the airfoil 102 that includes a traditional pin-bank (e.g., a pin-bank that is devoid cross-bars 122). Line 604 represents the first linear row A (of FIG. 4) at the trailing end 130 of the airfoil 102 that includes the cross-bank 106 (e.g., includes the cross-bars 122). At increasing mass flow rates of the cooling fluid exiting the cooling cavity directed through the trailing end 130 of the airfoil 102, the cross-bank 106 has greater heat transfer coefficient values than the traditional pin-bank (e.g., devoid cross-bars 122). Similarly, line 612 represents an alternative row (e.g., row F of FIG. 4) at the trailing end 130 of the airfoil 102 that includes the traditional pin-bank (e.g., a pin-bank that is devoid cross-bars 122). Line 614 represents the additional linear row F (of FIG. 4) at the trailing end 130 of the airfoil 102 that includes the cross-bank 106 (e.g., includes the additional cross-bars 122). At increasing mass flow rates of the cooling fluid exiting the cooling cavity directed through the trailing end 130 of the airfoil 102, the cross-bank 106 has greater heat transfer coefficient values than the traditional pin-bank (e.g., devoid the cross-bars 122). At the first row (e.g., row A) and at the alternative row (e.g., row F), the cross-bank 106 has improved heat transfer coefficient values at increasing mass flow rates compared to the traditional pin-bank that is devoid cross-bars 122.

FIGS. 7, 8, 9 and 10 illustrate four examples of cross-banks in accordance with four embodiments. The embodiments of FIGS. 7, 8, 9 and 10 are intended to be illustrative, and not restrictive. Alternative embodiments may be understood by combining one or more of the embodiments of FIGS. 7, 8 9 and 10 or any combination thereof.

Figure 7A:
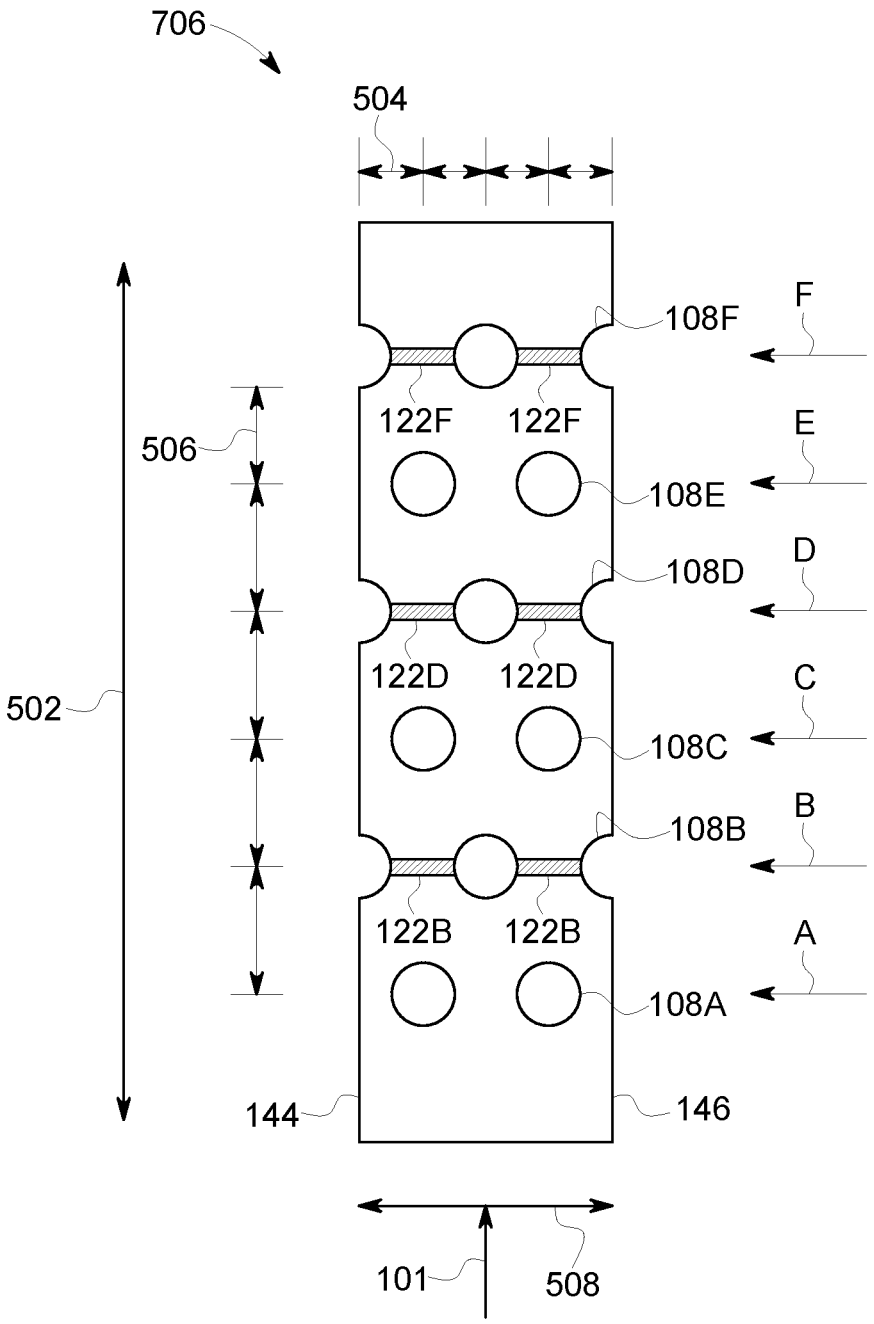
FIG. 7A illustrates a top view of a cross-bank in accordance with one embodiment.
Figure 7B:
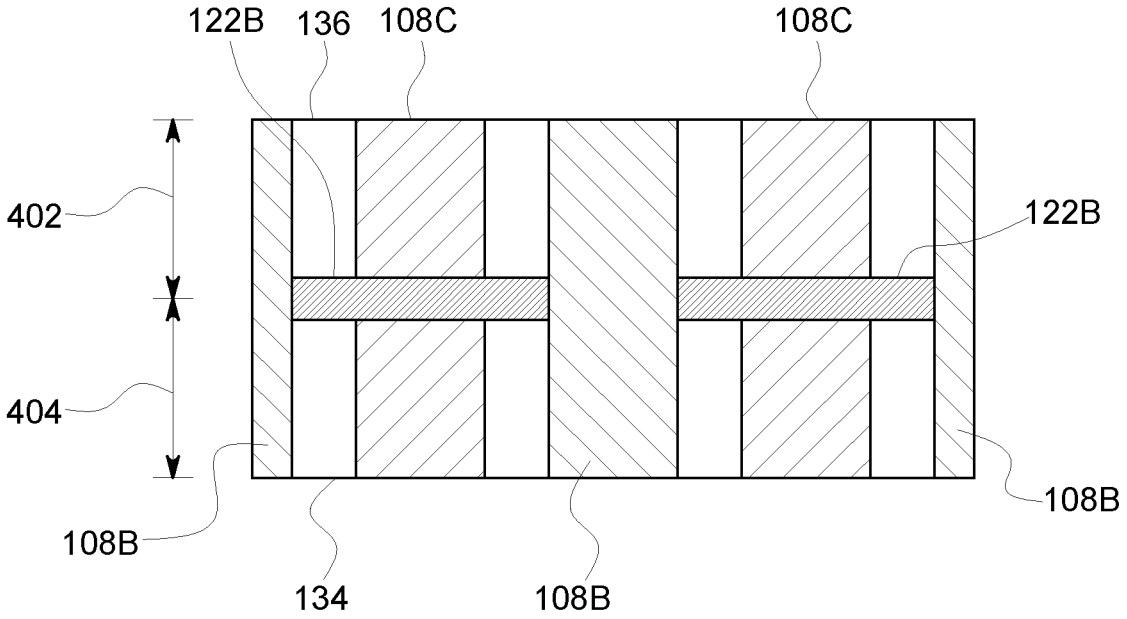
FIG. 7B illustrates a side view of the cross-bank of FIG. 7A in accordance with one embodiment.

FIG. 7A illustrates a top view of a cross-bank 706 in accordance with one embodiment. FIG. 7B illustrates a side view of the cross-bank 706. The cross-bank 706 extends the cross-bank length 502. The cooling cavity 104 (of FIG. 2A) directs cooling air through the cross-bank 706 in the direction 101. The cross-bank 706 includes pins 108 and cross-bars 122. The pins 108 of the rows A, B, C, D, E, and F are positioned the distance 506 apart along the cross-bank length 502. The cross-bank 706 extends the cross-bank width 508. The pins 108 of rows A, B, C, D, E and F are positioned the uniform staggered distance apart 504 along the cross-bank width 508. The cross-bars 122 extend between pins 108 and are positioned within the rows B, D and F. The rows A, C, and E are devoid cross-bars. Alternatively, fewer than three rows or more than three rows may include cross-bars 122 in any configuration (e.g., random, patterned, or the like). The cross-bars 122 are spaced apart from the first side interior surface 134 by the distance 404, and are spaced apart from the second side interior surface 136 by the distance 402.

Figure 8A:
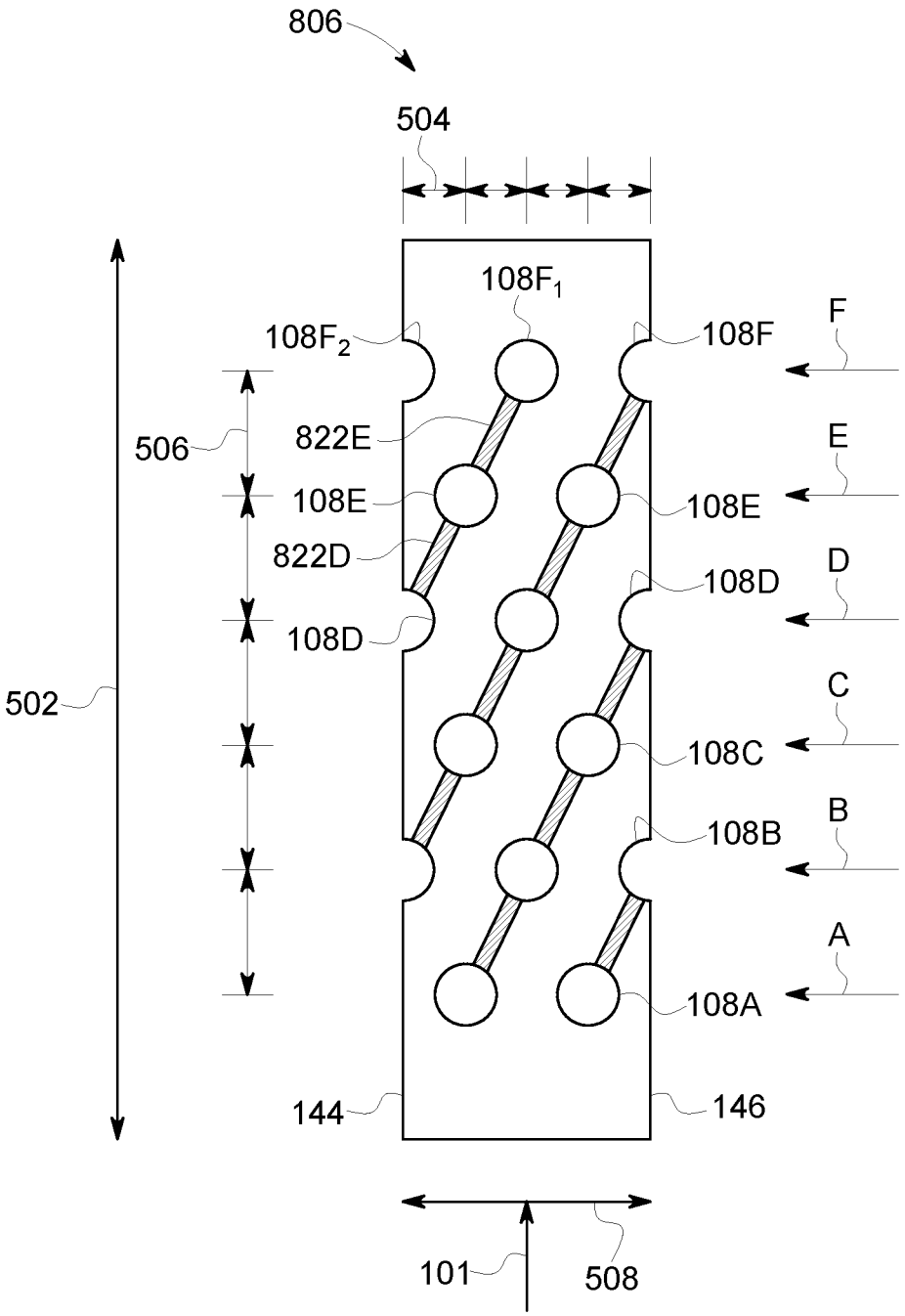
FIG. 8A illustrates a top view of a cross-bank in accordance with one embodiment.
Figure 8B:
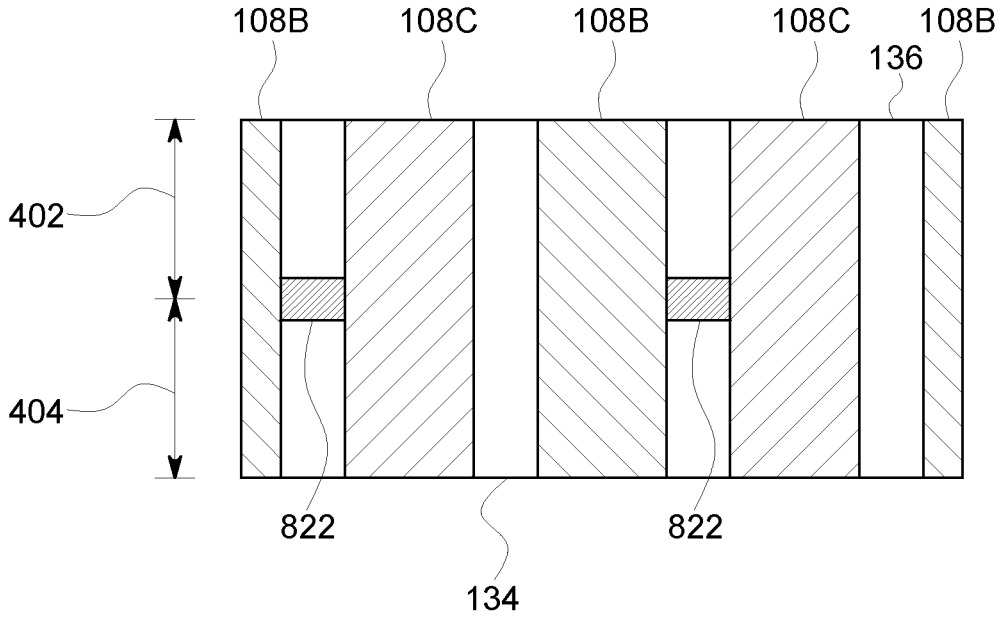
FIG. 8B illustrates a side view of the cross-bank of FIG. 8A in accordance with one embodiment.

FIG. 8A illustrates a top view of a cross-bank 806 in accordance with one embodiment. FIG. 8B illustrates a side view of the cross-bank 806. The cross-bank 806 extends the cross-bank length 502 and the cross-bank width 508. The cooling cavity 104 (of FIG. 2A) directs cooling air through the cross-bank 806 in the direction 101. The cross-bank 806 includes plural pins 108 and plural cross-bars 822. The pins 108 of the rows A, B, C, D, E and F are positioned the distance 506 apart along the cross-bank length 502, and are positioned the uniform staggered distance apart 504 along the cross-bank width 508. The cross-bars 822 extend between pins 108 in two different rows. For example, the cross-bar 822*d* extends between the pin 108*d* of row D and the pin 108*e* of row E. Similarly, the cross-bar 822*e* extends between the pin 108*e* of row E and the pin 108*f*1 of row F. Optionally, the cross-bar 822*e* may extend between the pin 108*e* of row E and the pin 108*f*2 of row F. In the illustrated embodiment, the cross-bars 822 of the cross-bank 806 extend between pins in a repeating pattern. Optionally, the cross-bars 822 may extend between pins of two or more rows in any configuration (e.g., random, patterned, or the like).

Figure 9A:
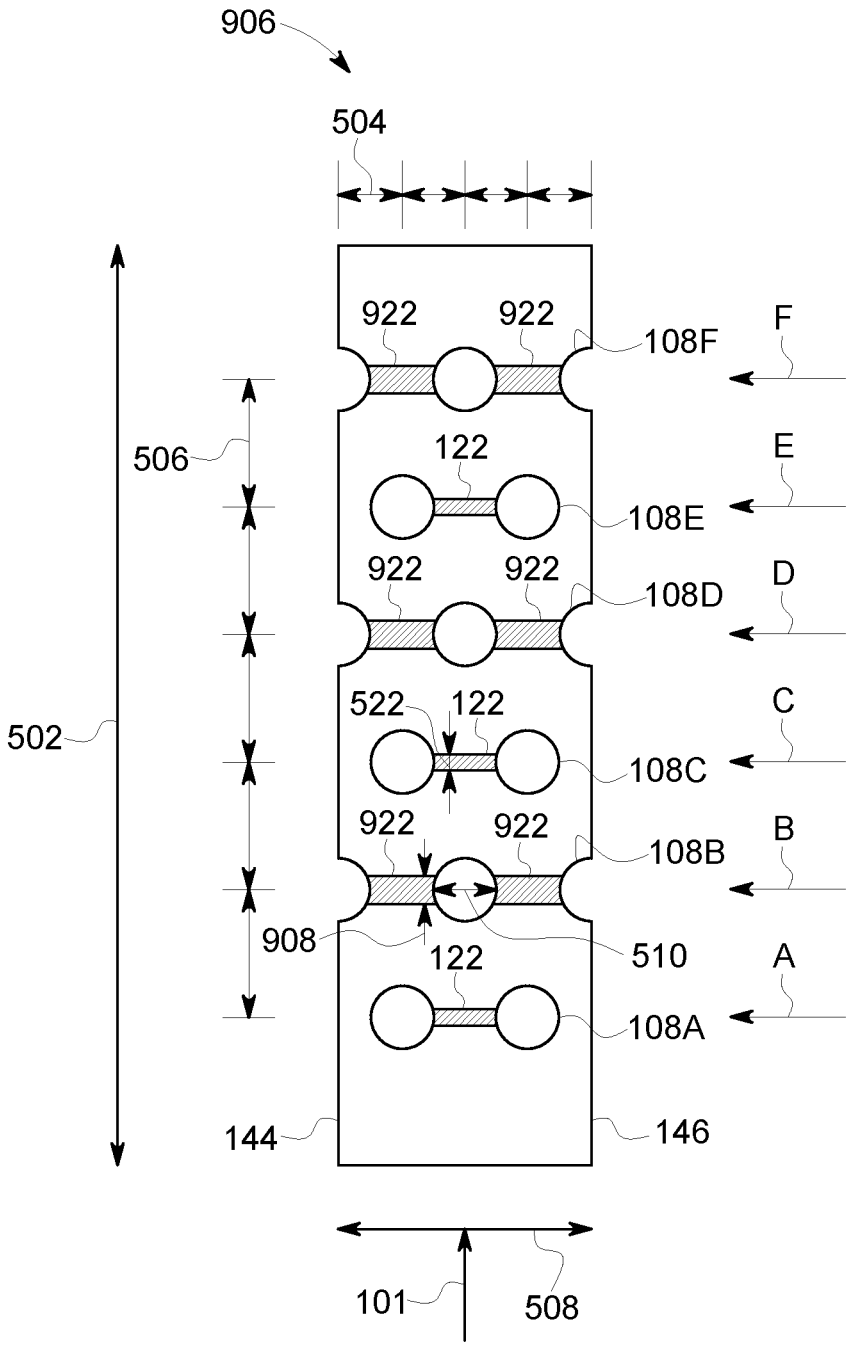
FIG. 9A illustrates a top view of a cross-bank in accordance with one embodiment.
Figure 9B:
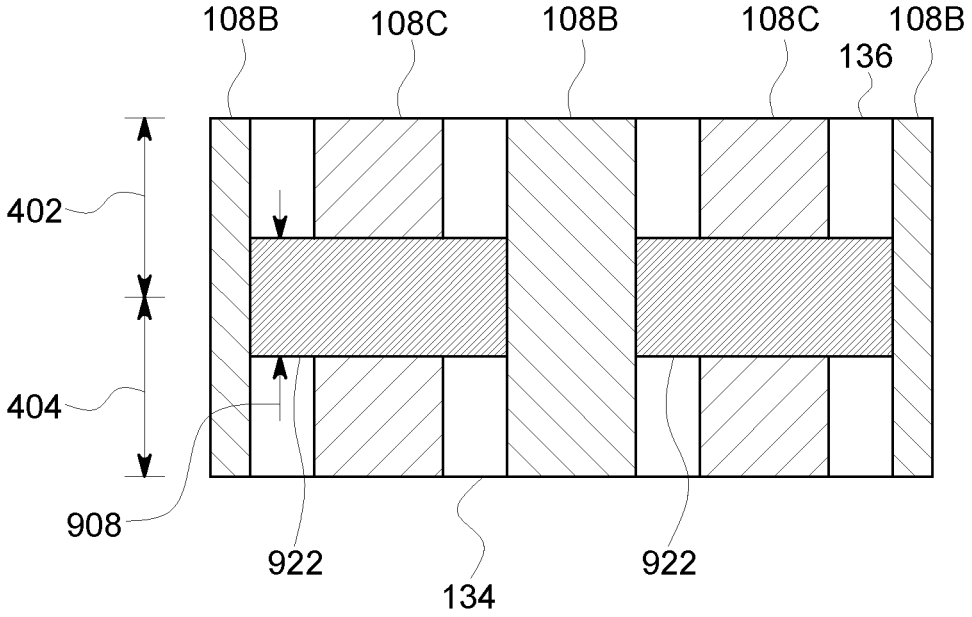
FIG. 9B illustrates a side view of the cross-bank of FIG. 9A in accordance with one embodiment.

FIG. 9A illustrates a top view of a cross-bank 906 in accordance with one embodiment. FIG. 9B illustrates a side view of the cross-bank 906. The cooling cavity 104 (of FIG. 2A) directs cooling air through the cross-bank 906 in the direction 101. The cross-bank 906 includes plural pins 108 within the rows A, B, C, D, E, and F, plural cross-bars 122 within the rows A, C, and E, and plural cross-bars 922 within the rows B, D, and F. The pins 108 have a generally circular first cross-sectional shape 510 and a first area corresponding to the first cross-sectional shape 510. The cross-bars 122 have a generally circular second cross-sectional shape 522 and a second area corresponding to the second cross-sectional shape 522. The cross-bars 922 have a generally circular third cross-sectional shape 908 and a third area corresponding to the third cross-sectional shape 908. The third area corresponding to the third cross-sectional shape 908 of the cross-bars 922 is greater than the second area corresponding to the second cross-sectional shape 522 of the cross-bars 122. Additionally, the third area corresponding to the cross-bars 922 is less than the first area corresponding to the first cross-sectional shape 510 of the pins 108. For example, the cross-bars 922 have an area that is greater than the area of the cross-bars 122 but less than the area of the pins 108. Optionally, one or more row A, B, C, D, E, or F may have one or more cross-bars 922 and one or more cross-bars 122. Optionally, the cross-bars 922 and the cross-bars 122 may be positioned between the pins 108 in any combination.

Figure 10A:
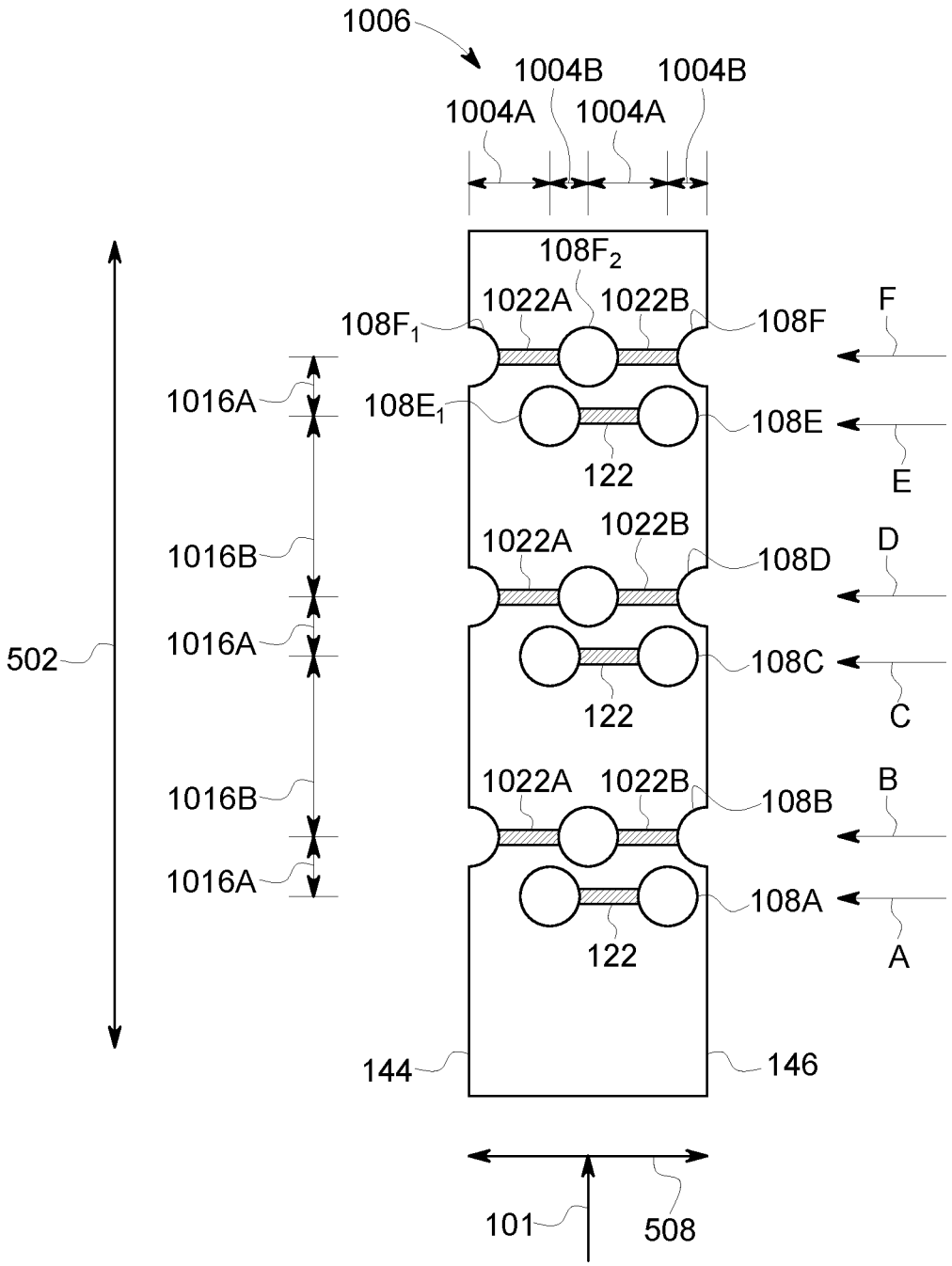
FIG. 10A illustrates a top view of a cross-bank in accordance with one embodiment.
Figure 10B:
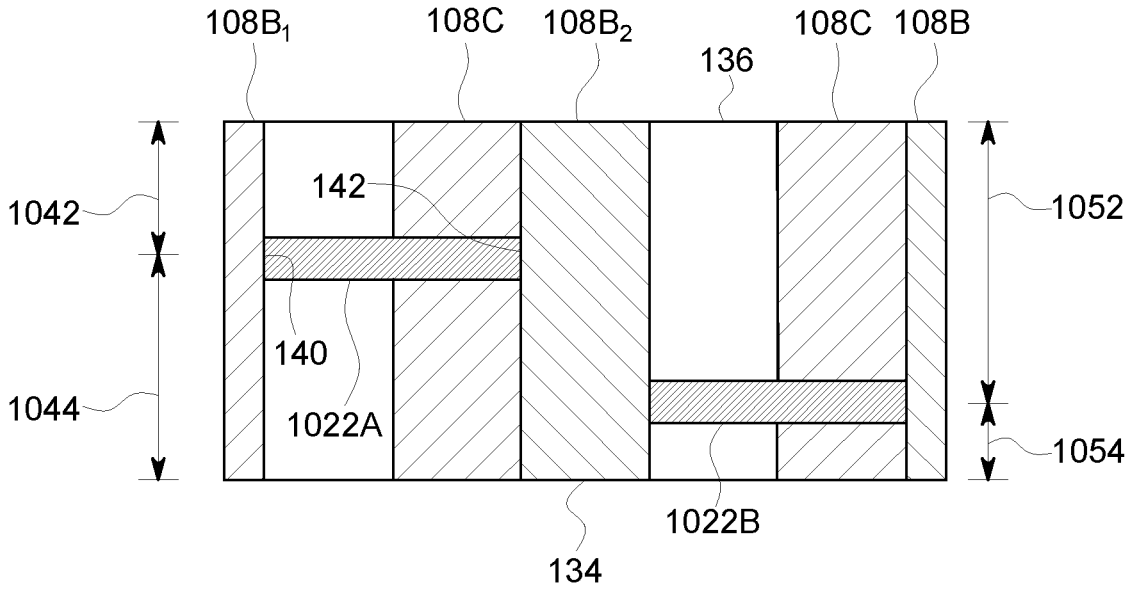
FIG. 10B illustrates a side view of the cross-bank of FIG. 10A in accordance with one embodiment.

FIG. 10A illustrates a top view of a cross-bank 1006 in accordance with one embodiment. FIG. 10B illustrates a side view of the cross-bank 1006. The cooling cavity 104 (of FIG. 2A) directs cooling air through the cross-bank 1006 in the direction 101. The cross-bank 1006 includes plural pins 108 and plural cross-bars 122, 1022*a*, and 1022*b*. The cross-bars 122 extend between pins 108 in the rows A, C and E. The cross-bars 1022*a*, 1022*b* extend between pins 108 in the rows B, D, and F. The cross-bank 1006 extends the cross-bank width 508. The pins 108 of the rows A, B, C, D, E and F are positioned a staggered distance apart 1004*a*, 1004*b* along the cross-bank width 508 wherein the distance 1004*a* is greater than the distance 1004*b*. For example, the pin 108*f*1 is spaced apart from the pin 108*e*1 by the distance 1004*a*, and the pin 108*e*1 is spaced apart from the pin 108*f*2 by the distance 1004*b* such that the in 108*e*1 is positioned closer to the pin 108*f*2 than the pin 108*f*1 along the cross-bank width 508. Optionally, one or more of the pins 108 of one or more of the rows A, B, C, D, E or F may be spaced apart one or more of a staggered distance greater than or less than the staggered distance 1004*a* or a distance greater than or less than the staggered distance 1004*b*.

The cross-bank 1006 extends the cross-bank length 502. The pins 108 are positioned distances 1016*a*, 1016*b* apart along the cross-bank length 502 wherein the distance 1016*a* is less than the distance 1016*b*. For example, the pins 108*a* of the row A are spaced apart the distance 1016*a* from the pins 108*b* of the row B, and the pins 108*b* of the row B are spaced apart the distance 1016*b* from the pins 108*c* of the row C along the cross-bank length 502 such that the pins 108*b* of the row B are positioned closer to the pins 108*a* of the row A than the pins 108*c* of the row C. Optionally, one or more of the pins 108 of one or more of the rows A, B, C, D, E or F may be spaced apart one or more of a distance greater than or less than the distance 1016*a* or a distance greater than or less than the distance 1016*b*.

The cross-bars 1022*a* are spaced apart from the first side interior surface 134 by a distance 1044. Additionally, the cross-bars 1022*a* are spaced apart from the second side interior surface 136 by a distance 1042 that is less than the distance 1044. For example, the cross-bars 1022*a* are disposed closer to the second side interior surface 136 than the first side interior surface 134. Additionally, the cross-bars 1022*b* are spaced apart from the first side interior surface 134 by a distance 1054 and the cross-bars 1022*b* are spaced apart from the second side interior surface 136 by a distance 1052 that is greater than the distance 1054. For example, the cross-bars 1022*b* are disposed closer to the first side interior surface 134 than the second side interior surface 136. Optionally, the first end 140 of one or more of the cross-bars 1022*a*, 1022*b* may be coupled with a first at a position closer to the second side interior surface 136 and the second end 142 may be coupled with a second pin at a position closer to the first side interior surface 134. For example, the cross-bars 1022*a* may extend generally perpendicular between the pins 108*b*1, 108*b*2 or may extend non-perpendicular between the pins 108*b*1, 108*b*2.

Figure 11A:
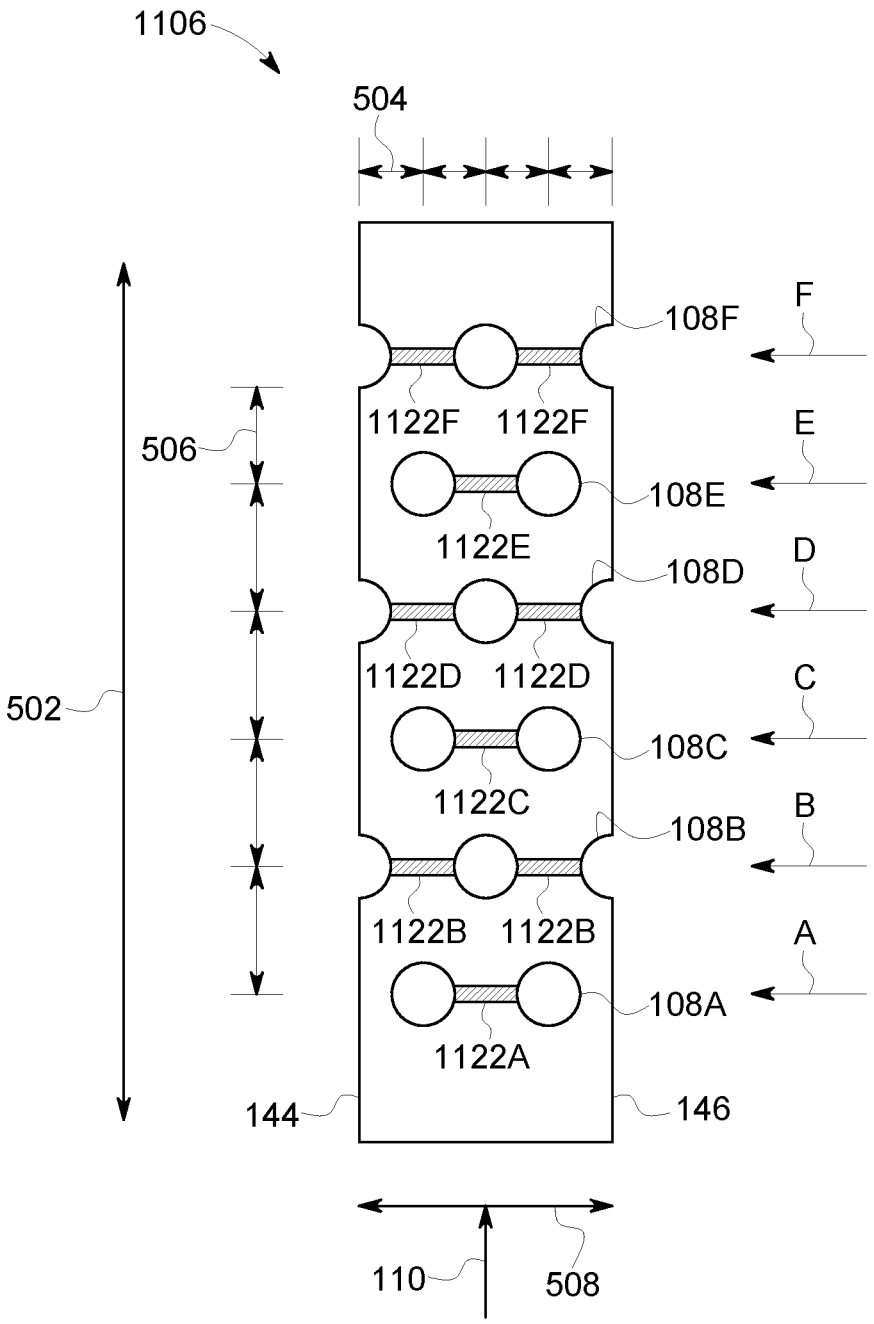
FIG. 11A illustrates a top view of a cross-bank in accordance with one embodiment.
Figure 11B:
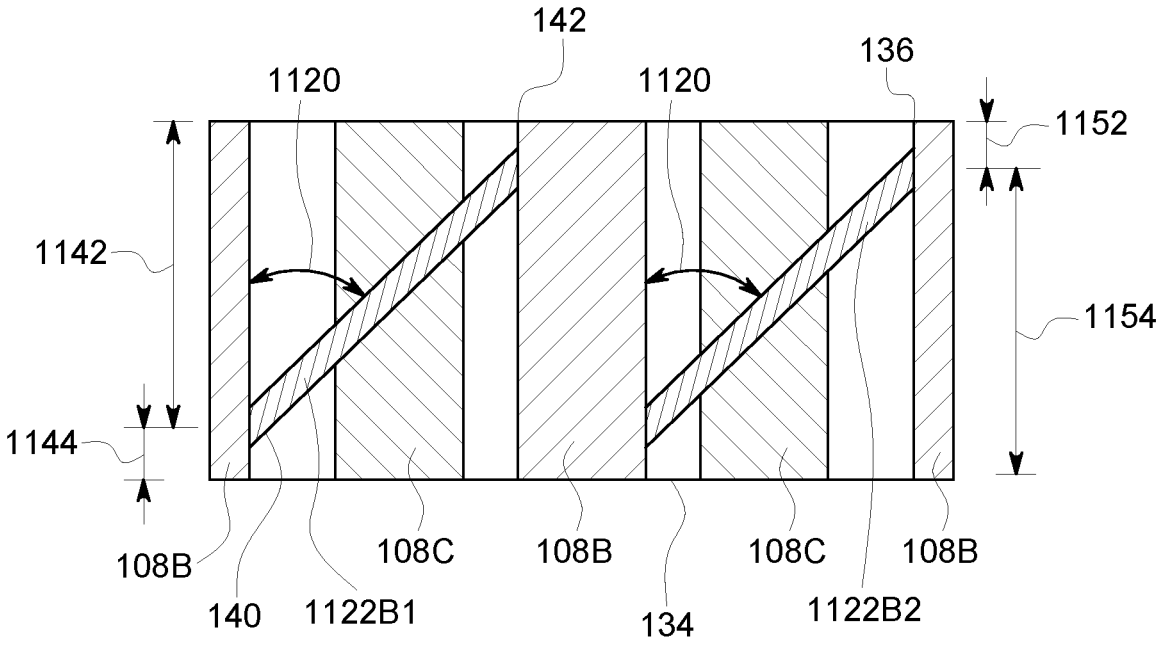
FIG. 11B illustrates a side view of the cross-bank of FIG. 11A in accordance with one embodiment.

FIG. 11A illustrates a top view of a cross-bank 1106 in accordance with one embodiment. FIG. 11B illustrates a side view of the cross-bank 1106. The cross-bank 1106 extends the cross-bank length 502 and the cross-bank width 508. The cooling cavity 104 (of FIG. 2A) directs cooling air through the cross-bank 1106 in the direction 101. The cross-bank 1106 includes plural pins 108 and plural cross-bars 1122 within the rows A, B, C, D, E, and F. The pins 108 are positioned the distance 506 apart along the cross-bank length 502, and are positioned the uniform staggered distance apart 504 along the cross-bank width 508.

The first ends 140 of the cross-bars 1122 are spaced apart from the second side interior surface 136 by a distance 1142. Additionally, the second ends 142 of the cross-bars 1122 are spaced apart from the second side interior surface 136 by a distance 1152. For example, the cross-bars 1122 are angularly offset from the exterior surface of the pins 108 by a distance 1120. The first ends 140 of the cross-bars 1122 are disposed closer to the first side interior surface 134 than the second side interior surface 136. Additionally, the second ends 142 of the cross-bars 1122 are disposed closer to the second side interior surface 136 than the first side interior surface 134. In the illustrated embodiment, the cross-bars 1122*b*1 and 1122*b*2 are angularly offset from the exterior surface of the pins 108*b* by the uniform distance 1120. Optionally, one or more of the cross-bars 1122 may be angularly offset from the exterior surface of one or more pins 108 by a distance greater than or less than the distance 1120. For example, the cross-bars 1122*b* may be angularly offset by the distance 1120, and the cross-bars 1122*d* may be angularly offset by a distance greater than the distance 1120.

Figure 12:
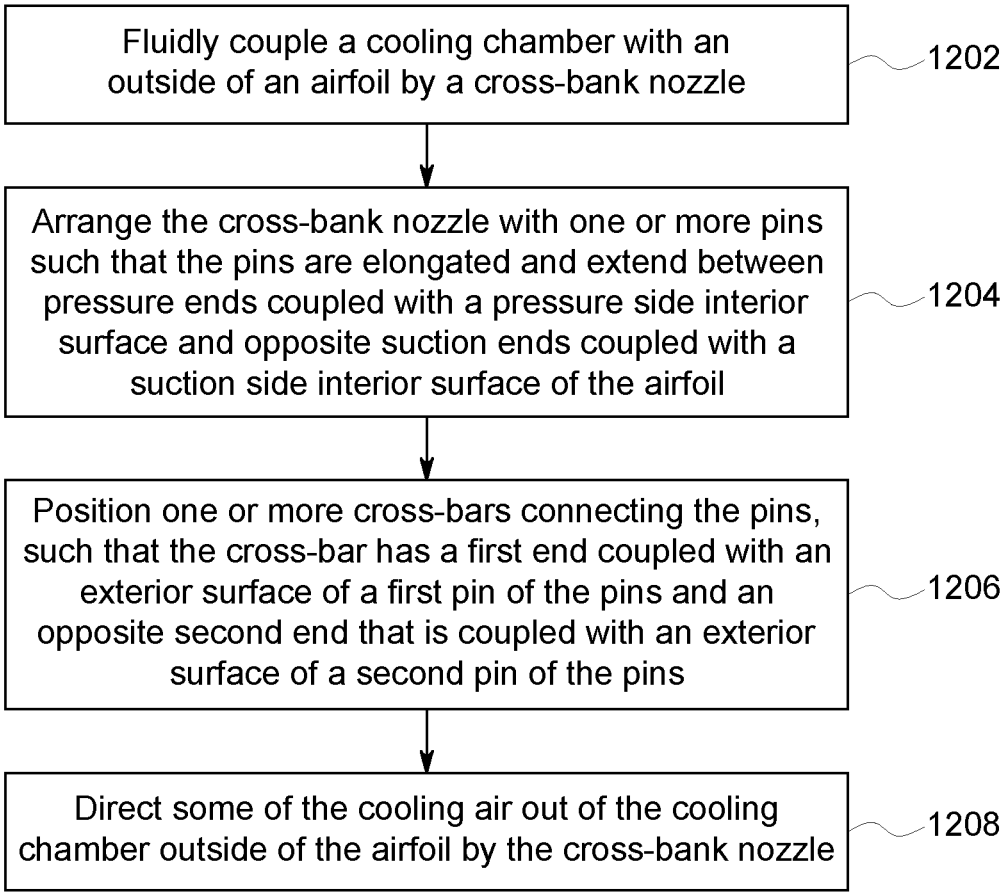
FIG. 12 illustrates a method flowchart in accordance with one embodiment.

FIG. 12 illustrates a method flowchart of operation of a cooling assembly (e.g., the cooling assembly 100) operating to cool an airfoil (e.g., the airfoil 102) of a turbine assembly in accordance with one embodiment. At 1202, a cooling cavity (e.g., the cooling cavity 104) is fluidly coupled with an outside of the airfoil 102 by a cross-bank (e.g., the cross-bank 106). For example, the cross-bank 106 may be a passage between the cooling cavity 104 and a trailing edge 120 at a trailing end 130 of the airfoil 102. At 1204, the cross-bank 106 is arranged with one or more pins 108 such that the pins are elongated and extend between first ends 110 coupled with a first side interior surface 134 of the airfoil 102 and second ends 112 coupled with a second side interior surface 136 of the airfoil 102. For example, the pins 108 may be arranged in linear rows (e.g., rows A, B, C, D, E, F) having one or more pins 108 in one or more linear rows.

At 1206, one or more cross-bars 122 are positioned connecting the pins 108. The cross-bars 122 have first ends 140 that couple with an exterior surface of a first pin 108 and opposite second ends 142 that couple with an exterior surface of a second pin 108. For example, the cross-bars 122 may connect two pins 108 within a first row, may connect a pin in a first row to a pin in a second row, or the like.

At 1208, cooling air is directed out of the cooling cavity 104 in the direction 101 outside of the airfoil 102 by the cross-bank 106. For example, at least some of the cooling air (e.g., air, fluid, coolant, or the like) flows from the cooling cavity 104, through the cross-bank 106, around the pins 108 and the cross-bars 122, to the outside of the trailing end 130 of the airfoil 102.

In one embodiment of the subject matter described herein, a cooling assembly comprises a cooling cavity disposed inside of a turbine assembly. The cooling cavity is configured to direct cooling air inside a body of the turbine assembly. The cooling assembly comprises a cross-bank fluidly coupled with the cooling cavity and positioned to direct at least some of the cooling air out of the cooling cavity and outside of the body. The cross-bank comprises plural pins having first ends coupled with a first side interior surface of the body and opposite second ends coupled with a second side interior surface of the body. The cross-bank also includes a cross-bar connecting the pins. The cross-bar extends between the pins such that the cross-bar has a first end coupled with an exterior surface of a first pin of the pins and an opposite second end coupled with an exterior surface of a second pin of the pins.

Optionally, the cross-bar is elongated along a bar plane and the pins are elongated along a different pin plane. Optionally, the cross-bar is elongated along a direction that is perpendicular to a direction in which the pins are elongated.

Optionally, the cooling cavity is shaped to direct the cooling air to flow in a direction that is perpendicular to a direction in which the pins are elongated.

Optionally, the body is an airfoil of the turbine assembly, and the cross-bank is disposed at a trailing end of the airfoil.

Optionally, the cross-bar is spaced apart from the first side interior surface of the body. Optionally, the cross-bar is spaced apart from the second side interior surface of the body.

Optionally, the pins are arranged in a first linear row and the cross-bank includes pins arranged in one or more additional rows. Optionally, the cooling assembly further comprises one or more additional cross-bars that connect the additional pins.

Optionally, the cross-bank further comprises additional plural pins and one or more additional cross-bars, wherein the one or more additional cross-bars connect the additional pins.

Optionally, the pins have a first cross-sectional shape having a first area, and the cross-bar has a second cross-sectional shape having a second area. Optionally, the first area is greater than the second area, such that the cross-bank has an area ratio between the pins and the cross-bar of at least one.

In another embodiment of the subject matter described herein, a cooling assembly comprises a cooling cavity disposed inside of a turbine assembly. The cooling cavity is configured to direct cooling air inside a body of the turbine assembly. The cooling assembly includes a cross-bank fluidly coupled with the cooling cavity and positioned to direct at least some of the cooling air out of the cooling cavity and outside of the body. The cross-bank comprises plural pins having first ends coupled with a first side interior surface of the body and opposite second ends coupled with a second side interior surface of the body. The cross-bank also includes a cross-bar connecting the pins, wherein the cross-bar is spaced apart from the first side interior surface and the cross-bar is spaced apart from the second side interior surface.

Optionally, the cross-bar extends between the pins such that the cross-bar has a first end coupled with an exterior surface of a first pin of the pins and an opposite second end coupled with an exterior surface of a second pin of the pins.

Optionally, the body is an airfoil of the turbine assembly, and the cross-bank is disposed at a trailing end of the airfoil.

Optionally, the pins are arranged in a first linear row and the cross-bank includes additional pins arranged in one or more additional linear rows. Optionally, the cooling assembly further comprises one or more additional cross-bars that connect the additional pins.

Optionally, the cross-bank further comprises additional plural pins and one or more additional cross-bars, wherein the one or more additional cross-bars connect the additional pins.

Optionally, the pins have a first cross-sectional shape having a first area, and the cross-bar has a second cross-sectional shape having a second area, wherein the first area is greater than the second area, such that the cross-bank has an area ratio between the pins and the cross-bar of at least one.

In another embodiment of the subject matter described herein, a cooling assembly comprises a cooling cavity disposed inside of a turbine assembly. The cooling cavity is configured to direct cooling air inside a body of the turbine assembly. The cooling assembly comprises a cross-bank fluidly coupled with the cooling cavity and positioned to direct at least some of the cooling air out of the cooling cavity and outside of the body. The cross-bank comprises plural pins arranged in linear rows. The pins having first ends coupled with a first side interior surface of the body and opposite second ends coupled with a second side interior surface of the body. The cross-bank also includes cross-bars connecting the pins. The cross-bars extending between the pins such that a first cross-bar of the cross-bars has a first end coupled with an exterior surface of a first pin of the pins and an opposite second end coupled with an exterior surface of a second pin of the pins. The cross-bars are spaced apart from the first side interior surface and the cross-bars are spaced apart from the second side interior surface.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A cooling assembly comprising:

a cooling cavity disposed inside of a turbine assembly, the cooling cavity configured to direct cooling air inside a body of the turbine assembly; and a cross-bank fluidly coupled with the cooling cavity and positioned to direct at least some of the cooling air out of the cooling cavity and outside of the body, the cross-bank comprising:

pins having first ends coupled with a first side interior surface of the body and opposite second ends coupled with a second side interior surface of the body; and a cross-bar connecting the pins, the cross-bar extending between the pins such that the cross-bar has a first end coupled with an exterior surface of a first pin of the pins and an opposite second end coupled with an exterior surface of a second pin of the pins, and wherein the cross-bar is elongated along a direction that is perpendicular to a direction in which the pins are elongated.

2. The cooling assembly of claim 1, wherein the cooling cavity is shaped to direct the cooling air to flow in a flow direction that is perpendicular to the direction in which the pins are elongated.

3. The cooling assembly of claim 1, wherein the body is an airfoil of the turbine assembly, the cross-bank is disposed at a trailing end of the airfoil.

4. The cooling assembly of claim 1, wherein the cross-bar is spaced apart from the first side interior surface of the body.

5. The cooling assembly of claim 1, wherein the cross-bar is spaced apart from the second side interior surface of the body.

6. The cooling assembly of claim 1, wherein the pins are arranged in a first linear row and the cross-bank includes additional pins arranged in one or more additional linear rows.

7. The cooling assembly of claim 6, further comprising one or more additional cross-bars that connect the additional pins.

8. The cooling assembly of claim 1, wherein the cross-bank further comprises additional pins and one or more additional cross-bars, wherein the one or more additional cross-bars connect the additional pins.

9. The cooling assembly of claim 1, wherein the pins have a first cross-sectional shape having a first area, and the cross-bar has a second cross-sectional shape having a second area.

10. The cooling assembly of claim 9, wherein the first area is greater than the second area, such that the cross-bank has an area ratio between the pins and the cross-bar of at least one.

11. A cooling assembly comprising:

a cooling cavity disposed inside of a turbine assembly, the cooling cavity configured to direct cooling air inside a body of the turbine assembly; and a cross-bank fluidly coupled with the cooling cavity and positioned to direct at least some of the cooling air out of the cooling cavity and outside of the body, the cross-bank comprising:

pins having first ends coupled with a first side interior surface of the body and opposite second ends coupled with a second side interior surface of the body; and a cross-bar connecting the pins, wherein the cross-bar is spaced apart from the first side interior surface, and the cross-bar is spaced apart from the second side interior surface, and wherein the cross-bar is elongated along a direction that is perpendicular to a direction in which the pins are elongated.

12. The cooling assembly of claim 11, wherein the cross-bar extends between the pins such that the cross-bar has a first end coupled with an exterior surface of a first pin of the pins and an opposite second end coupled with an exterior surface of a second pin of the pins.

13. The cooling assembly of claim 11, wherein the body is an airfoil of the turbine assembly, the cross-bank is disposed at a trailing end of the airfoil.

14. The cooling assembly of claim 11, wherein the pins are arranged in a first linear row and the cross-bank includes additional pins arranged in one or more additional linear rows.

15. The cooling assembly of claim 14, further comprising one or more additional cross-bars that connect the additional pins.

16. The cooling assembly of claim 11, wherein the cross-bank further comprises additional pins and one or more additional cross-bars, wherein the one or more additional cross-bars connect the additional pins.

17. The cooling assembly of claim 11, wherein the pins have a first cross-sectional shape having a first area, and the cross-bar has a second cross-sectional shape having a second area, wherein the first area is greater than the second area, such that the cross-bank has an area ratio between the pins and the cross-bar of at least one.

18. A cooling assembly comprising:

a cooling cavity disposed inside of a turbine assembly, the cooling cavity configured to direct cooling air inside a body of the turbine assembly; and a cross-bank fluidly coupled with the cooling cavity and positioned to direct at least some of the cooling air out of the cooling cavity and outside of the body, the cross-bank comprising:

pins arranged in linear rows, the pins having first ends coupled with a first side interior surface of the body and opposite second ends coupled with a second side interior surface of the body, wherein the cooling cavity is shaped to direct the cooling air to flow in a flow direction that is perpendicular to a direction in which the pins are elongated; and cross-bars connecting the pins, the cross-bars extending between the pins such that a first cross-bar of the cross-bars has a first end coupled with an exterior surface of a first pin of the pins and an opposite second end coupled with an exterior surface of a second pin of the pins, wherein the cross-bars are spaced apart from the first side interior surface, and the cross-bars are spaced apart from the second side interior surface.

* * * * *